US006718919B2

(12) United States Patent
Muraji

(10) Patent No.: US 6,718,919 B2
(45) Date of Patent: Apr. 13, 2004

(54) VALVE DRIVING APPARATUS

(75) Inventor: Tetsuo Muraji, Odawara (JP)

(73) Assignee: Mikuni Corporation, Tokyo (JP)

( * ) Notice: Subject to any disclaimer, the term of this patent is extended or adjusted under 35 U.S.C. 154(b) by 0 days.

(21) Appl. No.: 10/385,683

(22) Filed: Mar. 12, 2003

(65) Prior Publication Data

US 2003/0168030 A1 Sep. 11, 2003

Related U.S. Application Data

(62) Division of application No. 09/582,731, filed as application No. PCT/JP99/05441 on Oct. 4, 1999, now Pat. No. 6,561, 144.

(30) Foreign Application Priority Data

Nov. 4, 1998 (JP) ..... 10-313041
Aug. 11, 1999 (JP) ..... 11-227239

(51) Int. Cl.[7] ..... F01L 9/04

(52) U.S. Cl. ..... 123/90.11; 310/12; 251/129.01; 335/229

(58) Field of Search ..... 310/12, 13, 14, 310/15, 17, 30; 335/262, 229, 230, 234, 231, 235; 123/90.11; 251/129.01, 129.15, 65

(56) References Cited

U.S. PATENT DOCUMENTS 3,670,223 A * 6/1972 Pommeret ..... 318/124
3,860,839 A * 1/1975 Buchberger et al. ..... 310/12
4,965,864 A * 10/1990 Roth et al. ..... 318/135
5,022,353 A 6/1991 Kamamura
5,023,496 A * 6/1991 Niikura ..... 310/12
5,076,221 A 12/1991 Kawamura
5,124,598 A 6/1992 Kawamura
5,406,152 A * 4/1995 Fechner et al. ..... 310/15
5,444,313 A * 8/1995 Oudet ..... 310/17
5,536,983 A * 7/1996 Araki et al. ..... 310/12
5,559,378 A 9/1996 Oudet et al.
5,578,877 A * 11/1996 Tiemann ..... 310/15

FOREIGN PATENT DOCUMENTS

| | | |
|---|---|---|
| JP | 58-36680 | 3/1983 |
| JP | 59-70013 | 5/1984 |
| JP | 2-181011 | 7/1990 |
| JP | 2-286814 | 11/1990 |
| JP | 3-47414 | 2/1991 |
| JP | 5-280315 | 10/1993 |
| JP | 6-307215 | 11/1994 |
| JP | 7-224624 | 8/1995 |
| JP | 2772569 | 4/1998 |
| JP | 10-238648 | 9/1998 |

* cited by examiner

*Primary Examiner*—Thomas Denion
*Assistant Examiner*—Jaime Corrigan
(74) *Attorney, Agent, or Firm*—Wenderoth, Lind & Ponack, LLP

(57) ABSTRACT

A valve driving apparatus includes a magnetic flux generating element in which an electromagnetic coil is wound to generate magnetic flux, a magnetic field generating element which has at least two poles to distribute magnetic flux and form at least one magnetic field region, a drive means which includes a magnetic path member, and a magnetized member arranged in accordance with the magnetic field region and having two magnetized faces with mutually different polarity to be connected and moved together with a valve rod united with a valve element. A current supply means supplies driving current to the electromagnetic coil whereby the current has polarities corresponding to either a valve closing direction or a valve opening direction of the valve element. The apparatus reduce impact of valve seating with a simple structure and controls the valve with less power consumption and with precision.

7 Claims, 20 Drawing Sheets

VALVE DRIVING APPARATUS

This is a Divisional Application of U.S. patent application Ser. No. 09/582,731, filed Jun. 30, 2000 now U.S. Pat. No. 6,561,144, which was the National Stage of International Application No. PCT/JP99/05441, filed Oct. 4, 1999.

BACKGROUND OF THE INVENTION

1. Field of the Invention

This invention relates to a valve driving apparatus which drives a valve element to control the flow of intake gas or exhaust gas of an internal combustion engine.

2. Description of the Related Art

An electromagnetic valve drive apparatus controlling the opening and closing of valves by electromagnetic force is known as an apparatus driving valve bodies such as intake valves or exhaust valves which control the flow of intake gas or exhaust gas of an internal combustion engine. This apparatus does not control the valve opening and closing by a cam which is rotatably driven by a crankshaft, but is capable of controlling the valve opening and closing and its timing regardless of the cam configuration and cam rotational speed. However, by increasing the opening and closing speed of the valve, the valve is liable to collide with a surrounding member when the valve seats and, as a result, problems arise, such as abrasion of the valve and its surrounding member and the generation of impulse sounds. For example, an apparatus disclosed in Japanese Patent Kokai No. 10-141028 is provided with an air damper mechanism in the valve driving apparatus in order to reduce shocks during valve seating, thereby solving these problems. However, this valve driving apparatus has a complex structure, thereby creating a new problem.

Also, the valve driving apparatus in which the valves are driven by electromagnetic force needs a power supply to drive the apparatus, and conservation of the power consumption is also required. The apparatus which is disclosed in Japanese Patent Kokai No. 8-189315 attempts to conserve power by changing the valve travel distance according to the internal combustion engine driving condition. However, the reduction of the supplied power has caused new problems such as reduced driving force and decreased response characteristics of valve opening and closing.

Furthermore, in the apparatus which is disclosed in Japanese Patent No. 2,772,569, the valve driving force has been increased by arranging a plurality of fixed magnetic poles and controlling the current magnitude supplied to the energizing coil. However, this apparatus has caused the structure to become complex and an increase of power consumption.

As discussed above, the conventional electromagnetic valve driving apparatus which attempts to reduce the shock of the valve when the valve is seated requires a complex structure and increases power consumption in order to precisely control valve movement. Further, with regard to the conventional valve driving apparatus which applies soft ferromagnetic iron material to the moving element, it is also a problem to align the valve to a predetermined position when power to the valve driving apparatus is not applied.

The present invention has been devised in view of the foregoing problems and an object of the invention is to provide an electromagnetic force driven apparatus whereby the structure is simple and the valve seating shock is reduced. Further, valve control is precisely executed with low power consumption, thereby enabling the valve to be placed at a predetermined position when power to the valve driving apparatus is not applied.

OBJECTS AND SUMMARY OF THE INVENTION

The objects of the present invention is to simplify the structure of a valve driving apparatus and to reduce the shock when the valve is seated.

The valve driving apparatus of the present invention is a valve driving apparatus for deriving a valve element controlling intake gas flow or exhaust gas flow of an internal combustion engine. A magnetized path member comprises a magnetic flux generating element in which an electromagnetic coil is wound to generate magnetic flux and a magnetic field generating element comprising at least two pole members to distribute the magnetic flux to form at least one magnetic field. A magnetizing member moves within the magnetic field in cooperation with a valve rod formed integrally with the valve element. The member has two magnetized surfaces with mutually different polarities. A current supply supplies a driving current to the electromagnetic coil corresponding to the poles of either a valve opening direction or a valve closing direction of the valve element.

DETAILED DESCRIPTION OF THE PREFERRED EMBODIMENT

Embodiments of the present invention will now be described with reference to the drawings.

Figure 1:
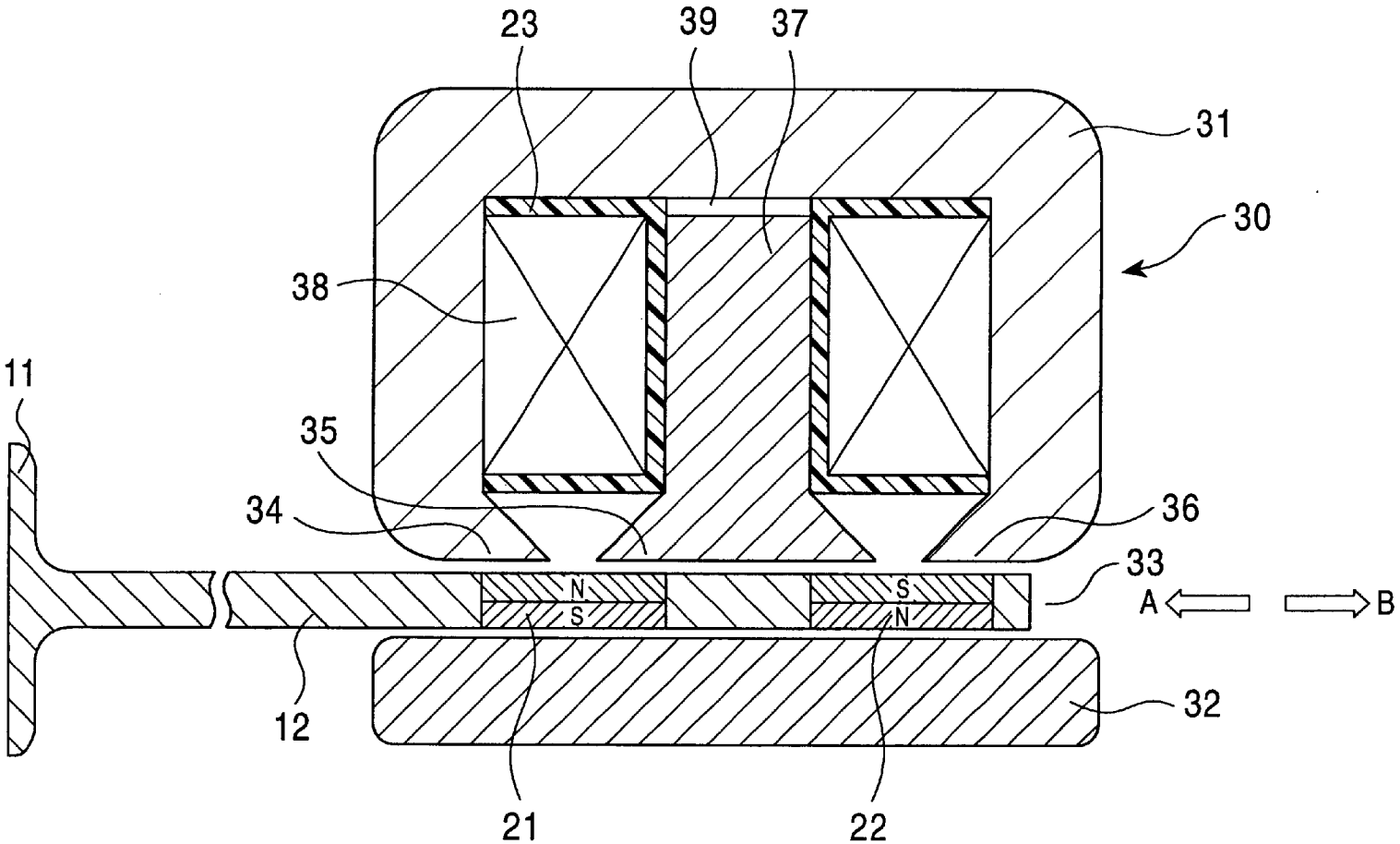
FIG. 1 is a sectional view showing a first embodiment of a valve driving apparatus of the present invention.

FIG. 1 shows a first embodiment of the valve driving apparatus of the present invention.

Figure 2:
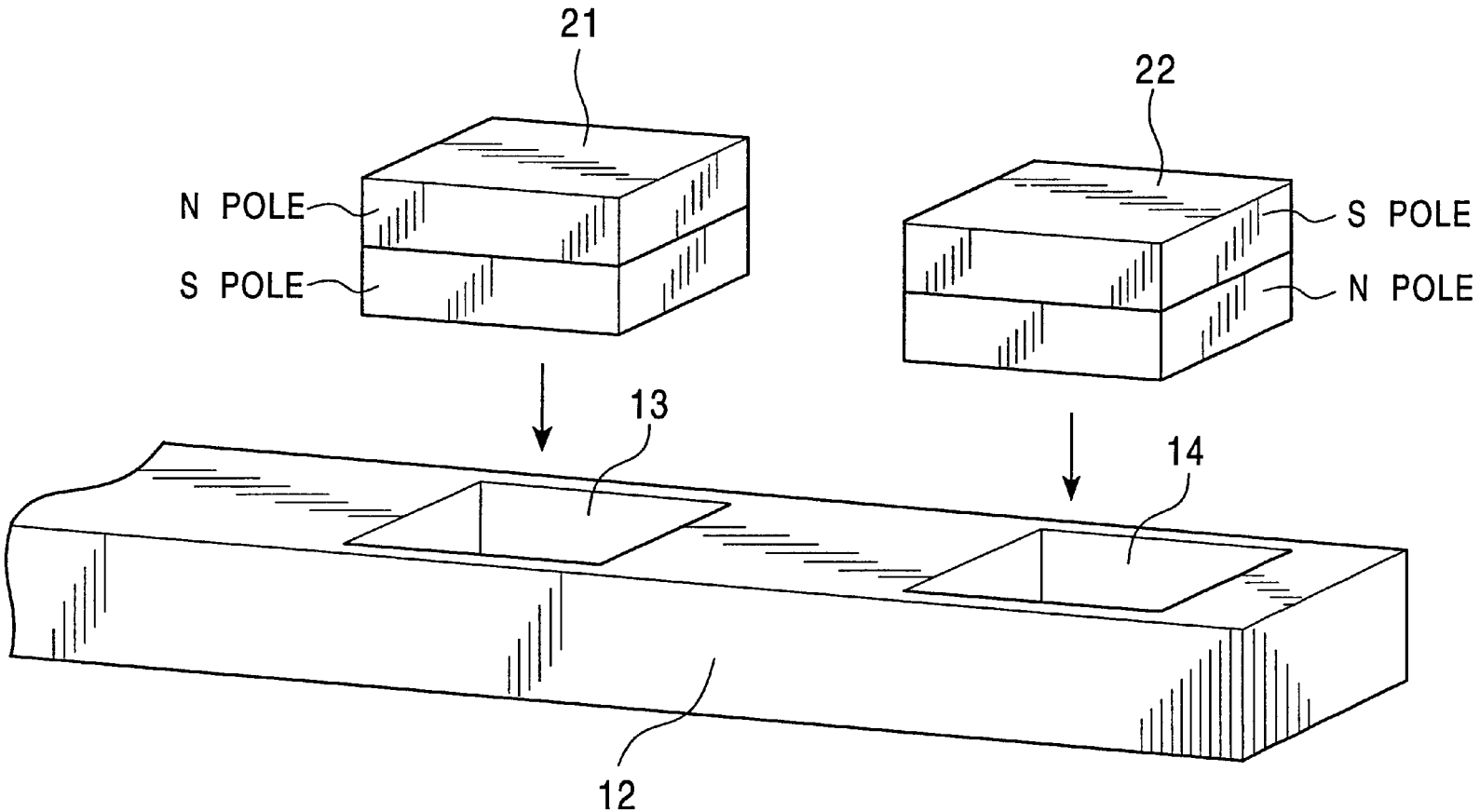
FIG. 2 is an enlarged exploded view of the valve driving apparatus shown in FIG. 1.

Valve 11 is integrally formed at one end of a valve rod 12. The region of the other end portion of the valve rod 12 has a rectangular sectional configuration and through holes 13 and 14 are arranged therein, as shown in FIG. 2. Two magnetized members 21 and 22 having a thickness the same as the valve rod 12 are inserted into the through holes 13 and 14, so that upper surfaces and lower surfaces of the magnetizing members are in planer alignment with the upper and the lower surface of the valve rod 12, respectively. The two magnetized members 21 and 22 are respectively arranged so that the opposing faces have a different magnetic polarity to each other. Magnetized members 21 and 22 are arranged so that the polarity of the two sides of magnetized member 21 have an opposite polarity when compared to the two sides of magnetized member 22. Along one side of a yoke 31 of the actuator 30, three poles 34, 35 and 36 are in parallel alignment in the lengthwise direction of the valve rod 12. The valve rod 12 and inserted magnetized members 21 and 22 are arranged in a gap 33 located between a yoke 32 and the magnetic poles 34, 35 and 36 which are separate elements.

Valve rod 12 is movable in both directions A and B, as shown in the figure. By moving the valve rod 12, the valve 11 may be moved to an opening position or closing position. Inside the gap 33, a magnetic field is formed in the regions of poles 34 and 35 and poles 35 and 36. Magnetized members 21 and 22 are arranged so that each member corresponds to each of the two magnetic field regions. In the central portion, the yoke 31 is formed around a core 37. Surrounding core 37 is a fixed frame 23 of nonmagnetic material such as resin. At a side wall portion of fixed frame 23, electromagnetic coil 38 is wound around core 37. A magnetic gap 39 is arranged between an upper end of core 37 and yoke 31. The electromagnetic coil 38 is connected to a current source not shown in the figure. The current source supplies a driving current to the electromagnetic coil 38. The polarity of the driving current corresponds to either the closing direction or the opening direction of the valve element 11.

In the following description, the magnetized member 21 facing the yoke 31 has a magnetic polarity of N, and a magnetic polarity of S on the side facing yoke 32, for example. The magnetized member 22 facing the yoke 31 has a magnetic polarity of S, and on the side facing yoke 32 has a magnetic polarity of N.

When current is not supplied to electromagnetic coil 38, the magnetic resistance of magnetic gap 39 is greater than the magnetic force of magnetized members 21 and 22. Therefore, magnetized members 21 and 22 and, therefore, the valve rod 12 are positioned to a predetermined position (referred to as reference position hereinafter). In the reference position, magnetic field paths are circumferentially formed in the following sequence: the N pole of magnetized member 21, magnetic pole member 34, yoke 31, magnetic pole member 36, the S pole of magnetized member 22, the N pole of magnetized member 22, yoke 32, and the S pole of magnetized member 21. A second sequence is: the N pole of magnetized member 21, magnetic pole member 35, the S pole of magnetized member 22, the N pole of magnetized member 22, yoke 32, and the S pole of magnetized member 21.

However, when current is supplied to electromagnetic coil 38, magnetic flux is generated inside core 37 and the magnetic flux is distributed inside yoke 31 to create a magnetic pole at each surface of poles 34, 35 and 36 and forms a magnetic field in the magnetic field region. The polarities of a magnetic dipole occurring at pole 34 and 36 are the same, whereas the polarity of the magnetic dipole occurring at pole 35 is of opposite polarity. For example, when direct current flowing in a predetermined direction is applied to electromagnetic coil 38, an S magnetic pole is created at poles 34 and 36, whereas an N magnetic pole is created at pole 35. When direct current flowing in the other direction is applied to electromagnetic coil 38, an N magnetic pole is created at poles 34 and 36, whereas an S magnetic pole is created at pole 35.

When an S magnetic pole is created at poles 34 and 36 and an N magnetic pole is created at pole 35, a new magnetic path is circumferentially formed in the following sequence: the N pole of magnetized member 21, magnetic pole member 34, yoke 31, magnetic gap 39, core 37, magnetic pole member 35, the S pole of magnetized member 22, the N pole of magnetized member 22, yoke 32, and the S pole of magnetized member 21 so as to move the magnetized members 21 and 22 together with valve rod 12 in the direction of arrow A, as shown in FIG. 1. On the contrary, when an N pole is created at poles 34 and 36 and S pole is created at pole 35, a new magnetic path is circumferentially formed in the following sequence: the N pole of magnetized member 21, magnetic pole member 35, core 37, magnetic gap 39, yoke 31, magnetic pole member 36, the S pole of magnetized member 22, the N pole of magnetized member 22, yoke 32, and the S pole of magnetized member 21 so as to move the magnetized members 21 and 22 together with valve rod 12 in the direction of arrow B.

As mentioned above, when current is not supplied to electromagnetic coil 38, valve 11 may be positioned to a predetermined position. By changing the direction of the current supplied to electromagnetic coil 38, valve rod 12 may be moved in either direction A or B so as to position the valve 11 to one of the opened position or the closed position.

Figure 3:
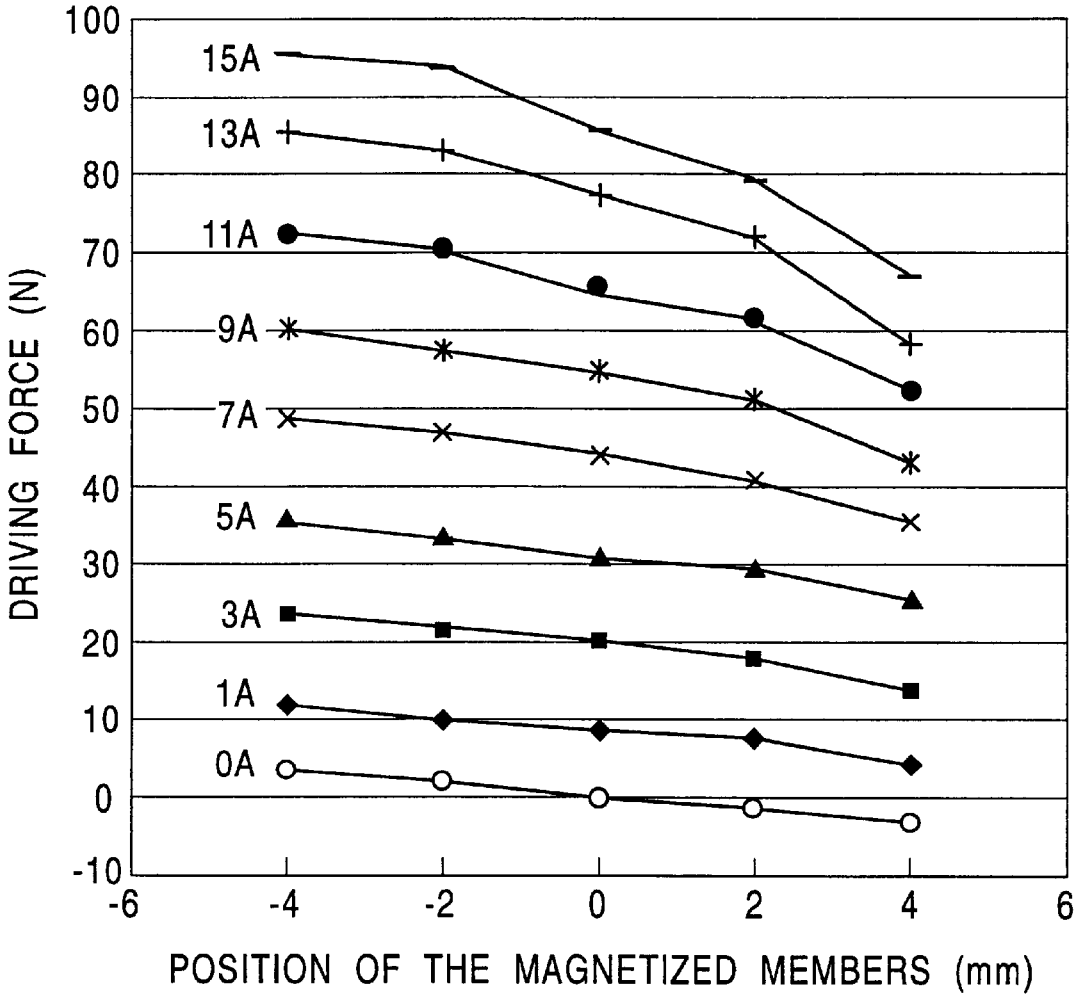
FIG. 3 is a graph showing the relationship between the moving distance of a magnetized member and the driving force applied to the magnetized member.

FIG. 3 shows the relationship between the position of the magnetized members and the driving force applied to the magnetized members when the moving distance of the magnetized member is ±4 millimeters, for example. This graph is obtained by applying a predetermined current (1 ampere to 15 ampere, for example) to the electromagnetic coil of the actuator and detecting the driving force required to stop the magnetized members in a predetermined position e.g., −4 mm to +4 mm.

The magnitude of driving force applied to magnetized members decreases as the position of the magnetized members moves in the positive direction. When the valve apparatus is in any one of the predetermined positions, as the magnitude of the current applied to the electromagnetic coil increases, the amount of driving force applied to the valve apparatus increases. The position of the magnetized members, when the driving force is zero, is the reference position of the magnetized members.

The graph of FIG. 3 shows the effect of direct current flowing in a predetermined direction applied to the electromagnetic coil. When the direct current flows in the opposite direction, then the driving force is reversed.

Driving force in a conventional apparatus as is disclosed in Japanese Patent No. 2,772,569 is in inverse proportion to the second power of the distance of the moving element, whereas the apparatus of the present invention, which is constructed as stated above, is able to provide a stable driving force without relying on the position of the magnetized members which are movable.

Figure 4:
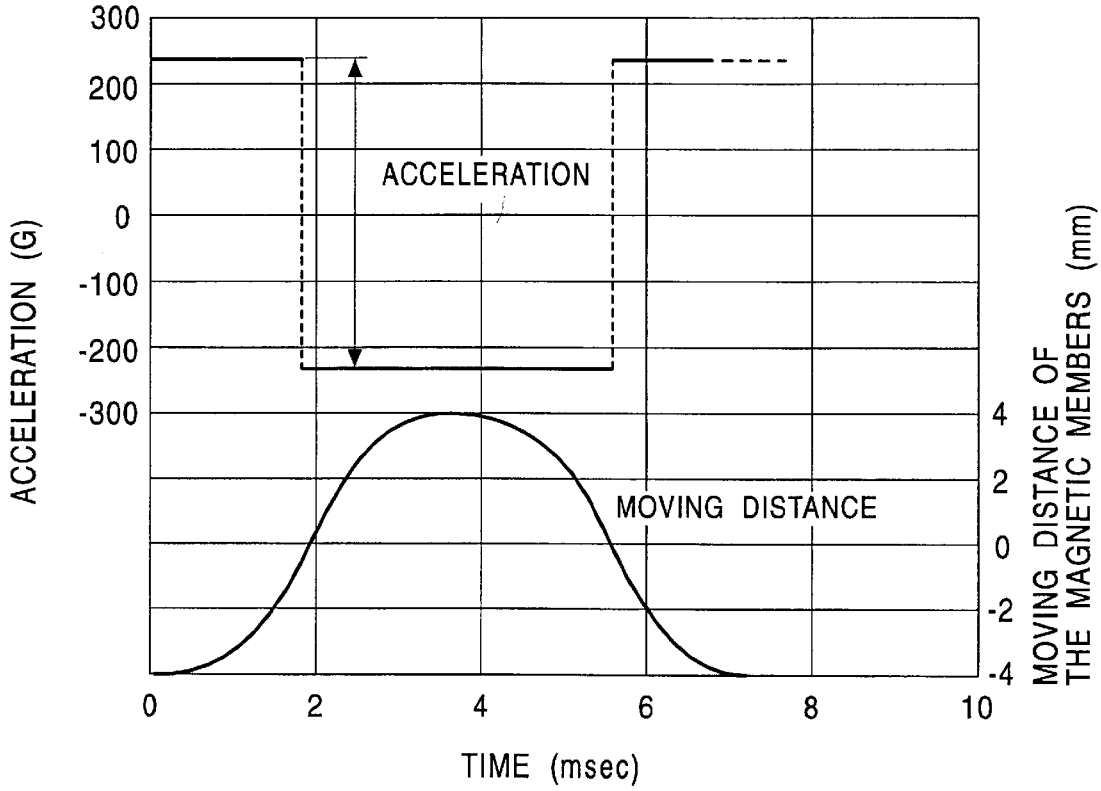
FIG. 4 is a graph showing the relationship between the time to move the magnetized member under optimized control, position of the magnetized member and the acceleration thereof.

FIG. 4 shows the relationship between the time required to transfer or move the magnetized members and position of the magnetized member as well as the acceleration of the magnetized members derived from numerical computation. In this graph, the internal combustion engine rotates at high-speed, 6000 rpm for example, and the magnetized members are moved together with the valve member and the valve rod.

As shown in the upper portion of the graph of FIG. 4, when driving force is applied to the magnetized members to drive the members, the transformation waveform acceleration is rectangularly shaped. The transformation waveform of displacement of the member is a curved line as shown in the lower portion of the graph of FIG. 4. Moreover, in this case, when the maximum moving distance of the magnetized members is set to a predetermined value (8 mm for example), the initial position of the magnetized members is −4 mm movement in direction B and the maximum moving distance of the magnetized members is +4 mm movement in the direction A. Then, controlling the velocity of the magnetized members at the initial position and maximum movement position, respectively, to zero velocity may be achieved by altering the acceleration of the magnetized members from −230G to +230G as shown in the upper portion of the graph of FIG. 4. As discussed above, valve 11 is integrally formed in one body by incorporating magnetized members 21, 22 and the valve rod 12, and the position where the magnetized members are located at the initial position corresponds to the valve closing position and the position where the magnetized members are positioned at the position of maximum movement corresponds to the valve opening position. In summary, in order to control the valve so that it does not collide with the valve seat as well as to position the valve at the valve closing and opening positions at a velocity of 0, an acceleration value of ±230G is applied to the magnetized member (valve element), for example. As a result, the apparatus of the present invention reduces valve impact upon seating by use of a simple structure.

Figure 5:
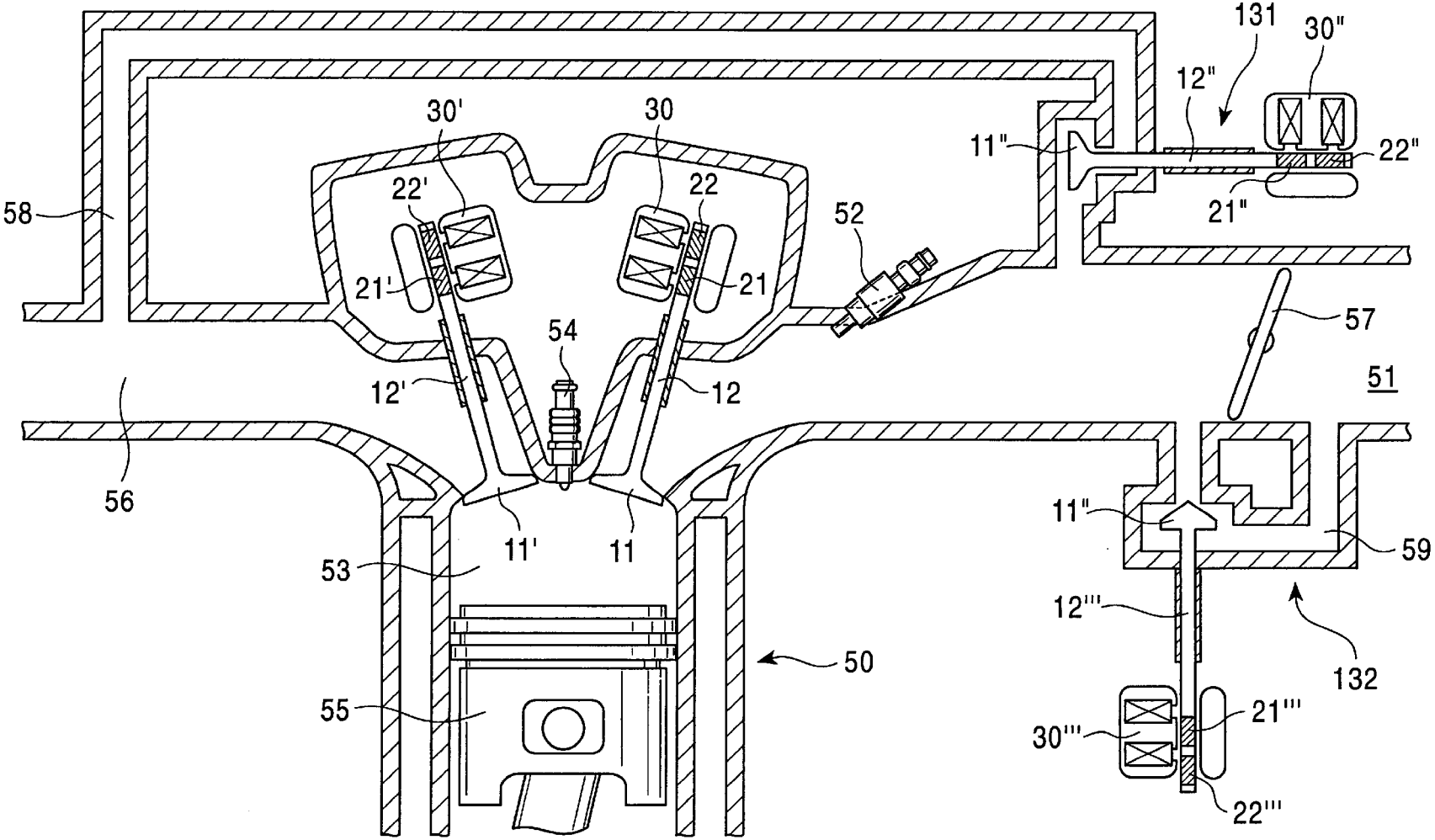
FIG. 5 is a sectional view of a combustion chamber region wherein in the valve driving apparatus shown in FIG. 1 is applied to the intake valve and the exhaust valve of the driving apparatus.

FIG. 5 shows a cross section of the region of the combustion chamber of an internal combustion engine, wherein the valve driving apparatus shown in FIG. 1 is applied to control the flow of intake gas and exhaust gas of the internal combustion. Components which correspond to components shown in FIG. 1 are given the same reference numbers.

From the suction pipe 51 of internal combustion engine 50, air having a flow rate controlled by throttle valve 57 is introduced to a combustion chamber intake. From the injector 52 located at the suction pipe 51, fuel is injected. Intake air and fuel is mixed in suction pipe 51 to form an air-fuel mixture. A crank angle sensor is arranged adjacent to the crank shaft (not shown) so that when the crank angle reaches a predetermined angle, a position signal pulse is transmitted. When the position signal pulse to initiate the intake stroke is transmitted from the crank angle sensor, current is supplied to actuator 30 to move the valve rod 12 inwardly in the direction of combustion chamber 53 together with the magnetized members 21 and 22 and to open the valve 11 to let the air-fuel mixture into the combustion chamber 53. Subsequently, when the position signal pulse to initiate the compression stroke is transmitted from the crank angle sensor, current in an opposite direction to the current applied at intake is applied to actuator 30 to move the valve rod 12 in the opposite direction to close the valve 11. When the position signal pulse to initiate the combustion stroke is transmitted, ignition plug 54 is ignited and air-fuel mixture in the combustion chamber 53 is combusted. This combustion increases the volume of air-fuel mixture and moves the piston 55 downward. This piston 55 motion is transmitted to the crank shaft and is converted to rotational motion of the crank shaft. When the position signal pulse to initiate the exhaust stroke is transmitted, current is supplied to actuator 30' and valve rod 12' moves inwardly in combustion chamber 53 together with the magnetized members 21' and 22' and opens the valve 11' to exhaust the combusted air-fuel mixture gas to exhaust pipe 56 as exhaust gas. Subsequently, when the position signal pulse to initiate the intake stroke is transmitted, valve 11' closes and the intake stroke of the next cycle begins.

Between the intake pipe 51 and exhaust-pipe 56 of the internal combustion engine 50, a re-circulation pipe 58 is arranged so as to be connected the intake and exhaust pipes. The re-circulation pipe 58 is provided with an exhaust gas re-circulation system 131 (hereinafter referred as anEGR system) to control the exhaust gas flow. Exhaust gas exhausted from internal combustion engine 50 is supplied to intake pipe 51 by flowing through the re-circulation pipe 58 and has its flow rate controlled by the EGR system 131. The EGR system 131 comprises the valve driving apparatus shown in FIG. 1,i.e., a valve 11", a valve rod 12", magnetized members 21" and 22", and an actuator 30". Thus, the valve driving apparatus controls the flow of the exhaust-gas supplied to intake pipe 51.

Further, intake pipe 51 of the internal combustion engine 50 has a by-pass pipe 59 which detours around the air supplied upstream of the throttle valve 57 and supplies the air to the downstream side of the throttle valve pipe 51. The by-pass pipe 59 is equipped with an idle speed control unit 132 (hereinafter referred to as an ISC system) to control the air flow rate supplied to the internal combustion engine 50. The ISC system comprises a valve driving apparatus shown in FIG. 1, i.e., a valve 11''', a valve rod 12''', magnetized members 21''' and 22''', and an actuator 30'''. Thus, the valve driving apparatus controls the air flow rate supplied to the internal combustion engine 50.

Intake gas supplied to internal combustion engine 50 comprises air supplied to intake pipe 51 and air supplied through the ISC system 132 to the downstream side of intake pipe 51 as mentioned above, while exhaust gas exhausted from the internal combustion engine 50 comprises exhaust-gas exhausted from the internal combustion engine 50 and exhaust-gas supplied to the EGR system.

The internal combustion engine shown in FIG. 5 is not limited to the valve driving apparatus of the first embodiment shown in FIG. 1. For example, the second to sixth embodiments of the valve driving apparatus, to be discussed later, may also be applied.

Figure 6:
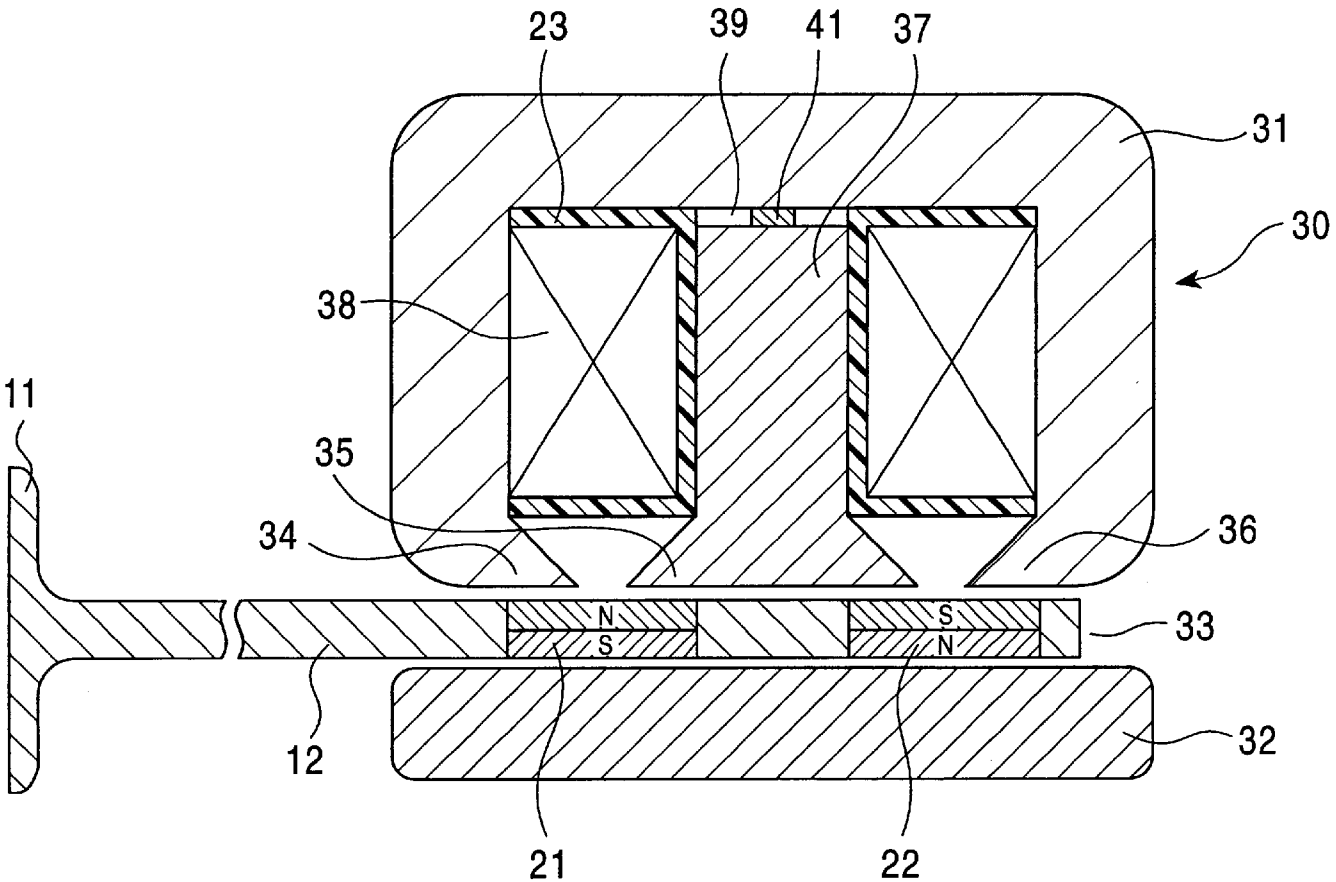
FIG. 6 is a sectional view showing a second embodiment of the valve driving apparatus.

FIG. 6 shows a valve driving apparatus of the second embodiment of the present invention. Components which correspond to components shown in FIG. 1 are given the same reference numbers.

A hole sensor 41 is arranged in magnetic gap 39 and detects the flux density which passes through the magnetic gap 39. A voltage signal which corresponds to the detected magnetic flux density is transmitted from hole sensor 41 and the voltage signal is supplied to a position detecting signal processor (not shown). As mentioned above, the position of magnetized members 21 and 22 is determined according to the magnitude of generated flux density in core 37 or flux density which passes through the magnetic gap 39. Therefore, by detecting the flux density, the position of magnetized members 21 and 22 may be obtained. By providing driving current to electromagnetic coil 38 corresponding to the position of magnetized members 21 and 22, the valve 11 may be controlled accurately.

Figure 7:
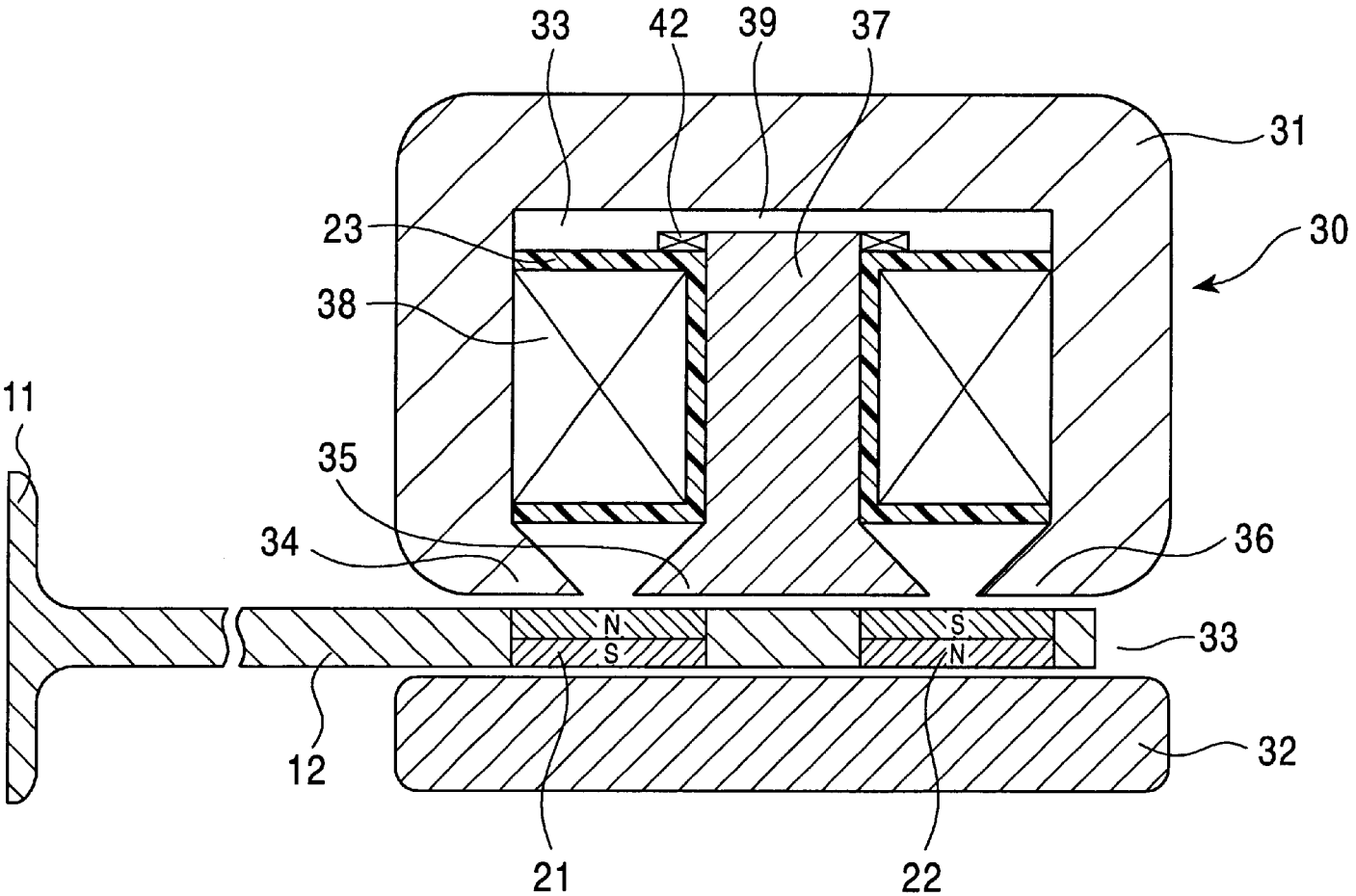
FIG. 7 is a sectional view showing a third embodiment of the valve driving apparatus.

FIG. 7 shows a valve driving apparatus of the third embodiment of the present invention. Components which correspond to components shown in FIGS. 1 and 6 are numbered in the same manner.

Electromagnetic coil 42 is wound at the upper end of core 37 and detects transformation of the magnetic flux generated in core 37 and outputs a voltage signal which corresponds to the detected magnetic flux to be supplied to a velocity detecting signal processor (not shown). Since magnetic flux generated in core 37 changes according to the velocity of the magnetized member, by detecting the transformation of the flux density, the velocity of the magnetized members 21 and 22 may be obtained so as to allow precise control of the valve 11 by supplying driving current corresponding to the velocity of the members 21 and 22 to the electromagnetic coil 38.

Figure 8:
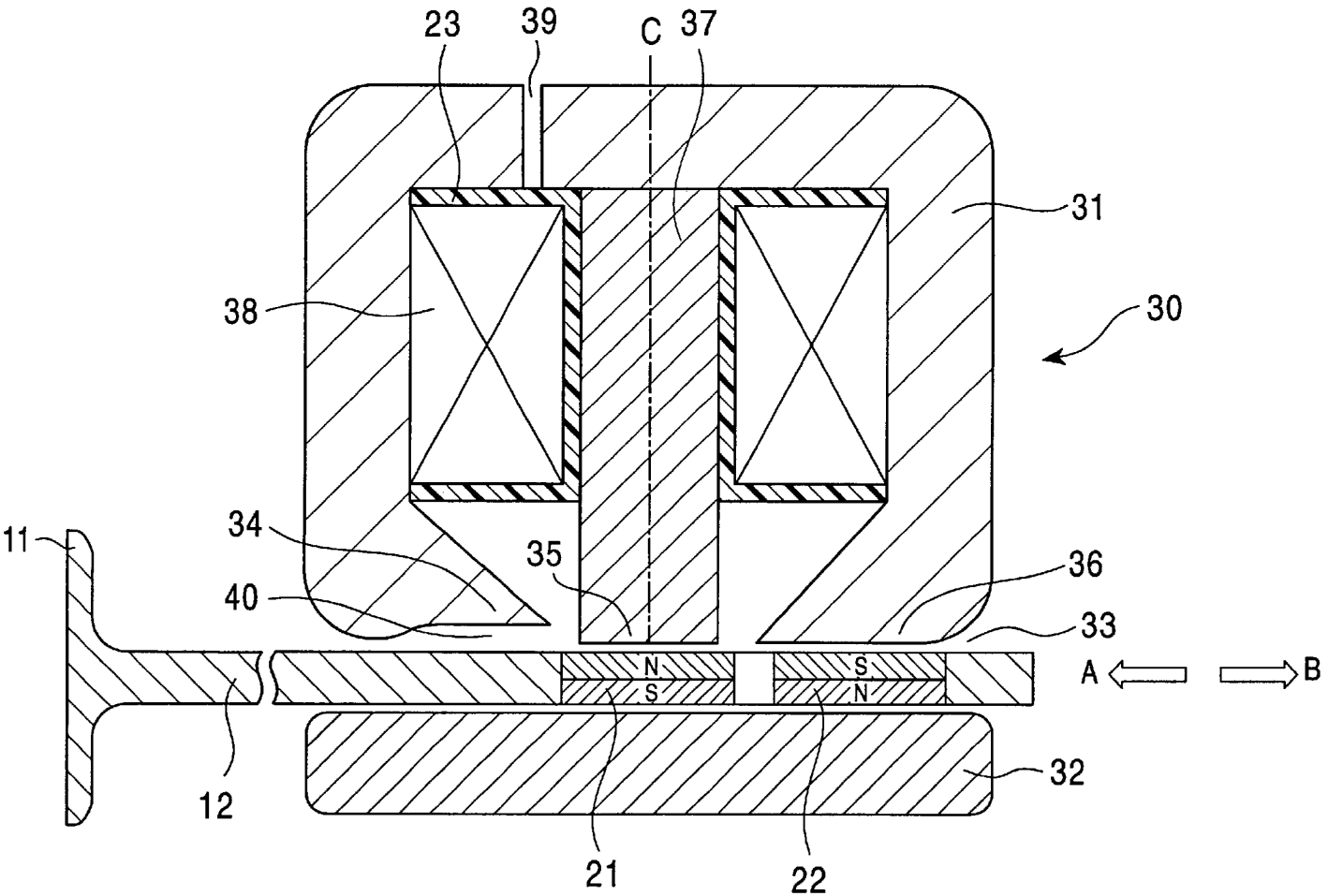
FIG. 8 is a sectional view showing a fourth embodiment of the valve driving apparatus.

FIG. 8 shows the valve driving apparatus of the fourth embodiment of the present invention. Components which correspond to components shown in FIGS. 1, 6 and 7 are given the same reference numbers.

Magnetic gap 39 is arranged at yoke 31 in a position offset to the side of pole 34 with respect to the center line C of the core 37. A magnetic gap 40 is arranged in the lower part of pole 34. As will be described later, when current is not supplied to electromagnetic coil 38, valve rod 12 is located below pole 34 so that the magnetic gap 40 is identified as a gap formed between pole 34 and valve rod 12. To the contrary, when current is supplied to electromagnetic coil 38, valve rod 12 moves in the direction of arrow A, shown in the figure, together with magnetized members 21 and 22 to place the magnetized member 21 underneath pole 34 so that magnetic gap 40 is identified as a gap formed between pole 34 and magnetized member 21. Pole element 34 is formed so that the dimension of the gap along the overall length direction of the valve rod is constant.

In this valve driving apparatus, when current is not supplied to electromagnetic coil 38, the magnetic resistance of magnetic gaps 39 and 40 is greater than the magnetic force of magnetized members 21 and 22. Therefore, magnetized members 21 and 22 are positioned to a predetermined position offset in the direction B, in the figure, together with valve rod 12, 50 that a magnetic path is circumferentially formed in the following sequence: the N pole of magnetized member 21, magnetic pole member 35, core 37, yoke 31, magnetic pole member 36, the S pole of magnetized member 22, the N pole of magnetized member 22, yoke 32, and S pole of magnetized member 21. In the case of the valve driving apparatus shown in FIG. 8, this position becomes a reference position and when current is not supplied to electromagnetic coil 38, valve rod 12 is always set to this reference position.

However, when current is supplied to electromagnetic coil 38, magnetic flux passes through both gaps 39 and 40. Therefore, magnetized members 21 and 22 move in the direction A, shown in the figure, together with valve rod 12, so that a magnetic path is circumferentially formed in the following sequence: the N pole of magnetized member 21, magnetic gap 40, pole member 34, yoke 31, magnetic gap 39, yoke 31, core 37, magnetic pole member 35, the S pole of magnetized member 22, the N pole of magnetized member 22, yoke 32, and the S pole of magnetized member 21. A second sequence is: the N pole of magnetized member 21, magnetic gap 40, pole member 34, yoke 31, magnetic gap 39, yoke 31, magnetic pole member 36, the S pole of magnetized member 22, the N pole of magnetized member 22, yoke 32, and the S pole of magnetized member 21.

Further, when current supplied to electromagnetic coil 38 is increased, magnetized members 21 and 22 move in the direction A in the figure, together with valve rod 12, so that a magnetic path is circumferentially formed solely in the sequence of the N pole of magnetized member 21, magnetic gap 40, pole member 34, yoke 31, magnetic gap 39, yoke 31, core 37, magnetic pole member 35, the S pole of magnetized member 22, the N pole of magnetized member 22, yoke 32, and the S pole of magnetized member 21.

As mentioned above, in the valve driving apparatus shown in FIG. 8, when current is not supplied to electromagnetic coil 38, valve rod 12 is always set to a predetermined position offset in the direction of arrow B as a reference position. However, where magnetic gap 39 is arranged at yoke 31 in a position offset to the pole 36 side from the central line of the core 37 and the magnetic gap 40 is arranged in the lower part of pole 36, when current is not supplied to electromagnetic coil 38, valve rod 12 is always set to a predetermined position offset in the direction of arrow A as reference position. By changing the location of magnetic gaps 39 and 40, one may select the reference position to be either a position offset in the direction of arrow A (valve open position, for example) or a position offset in the direction of arrow B (valve close position, for example).

When varying the gap size of magnetic gaps 39 and 40, the magnitude of magnetic resistance of magnetic gaps 39 and 40 also varies. Furthermore, the magnitude of magnetic resistance of magnetic gap 40 changes as magnetized members 21 and 22 move with valve rod 12. Therefore, when magnetic gaps 39 and 40 are changed, even when the magnitude of the current supplied to electromagnetic coil 38 is the same, the formed flux density of the magnetic flux and transformation of the flux density varies. This enables one to establish the required driving force magnitude or driving force transformation rate of the valve rod 12 and magnetized members 21 and 22.

In the aforesaid embodiment, among the plurality of poles positioned in parallel along the lengthwise direction of the valve rod, an example is shown wherein a magnetic gap 40 is arranged at the lower portion of the extreme outer side pole. However, the magnetic gap may be arranged at location of any of the other poles. Also, the magnetic gap dimension (the gap dimension between the valve rod and the pole or gap dimension between the magnetized member and the pole) of the disclosed embodiment is substantially uniform along the lengthwise direction of the valve rod, but the gap may be configured to vary.

Figure 9:
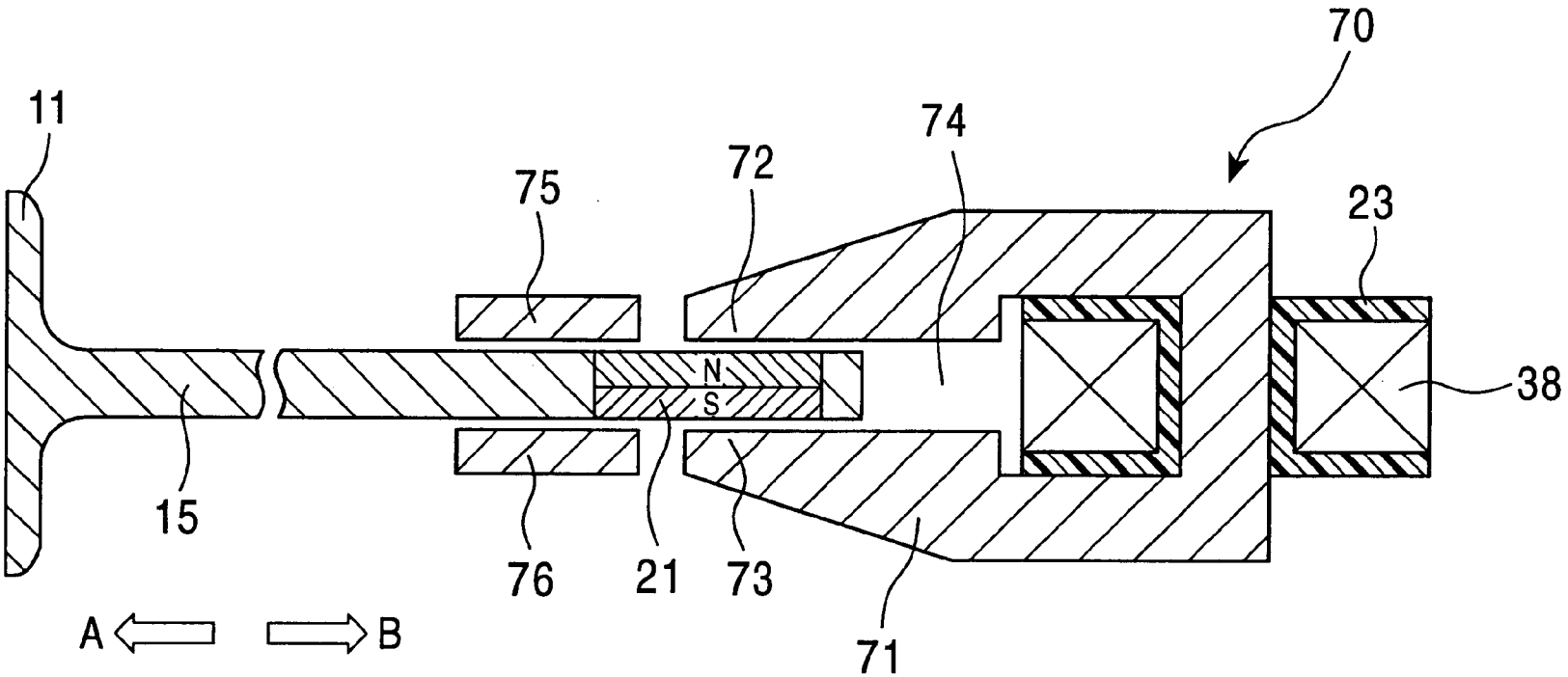
FIG. 9 is a sectional view showing a fifth embodiment of the valve driving apparatus.

FIG. 9 shows a valve driving apparatus of the fifth embodiment of the present invention. Components which correspond to components shown in FIGS. 1, 6, 7 and 8 are given the same reference numbers.

Figure 10:
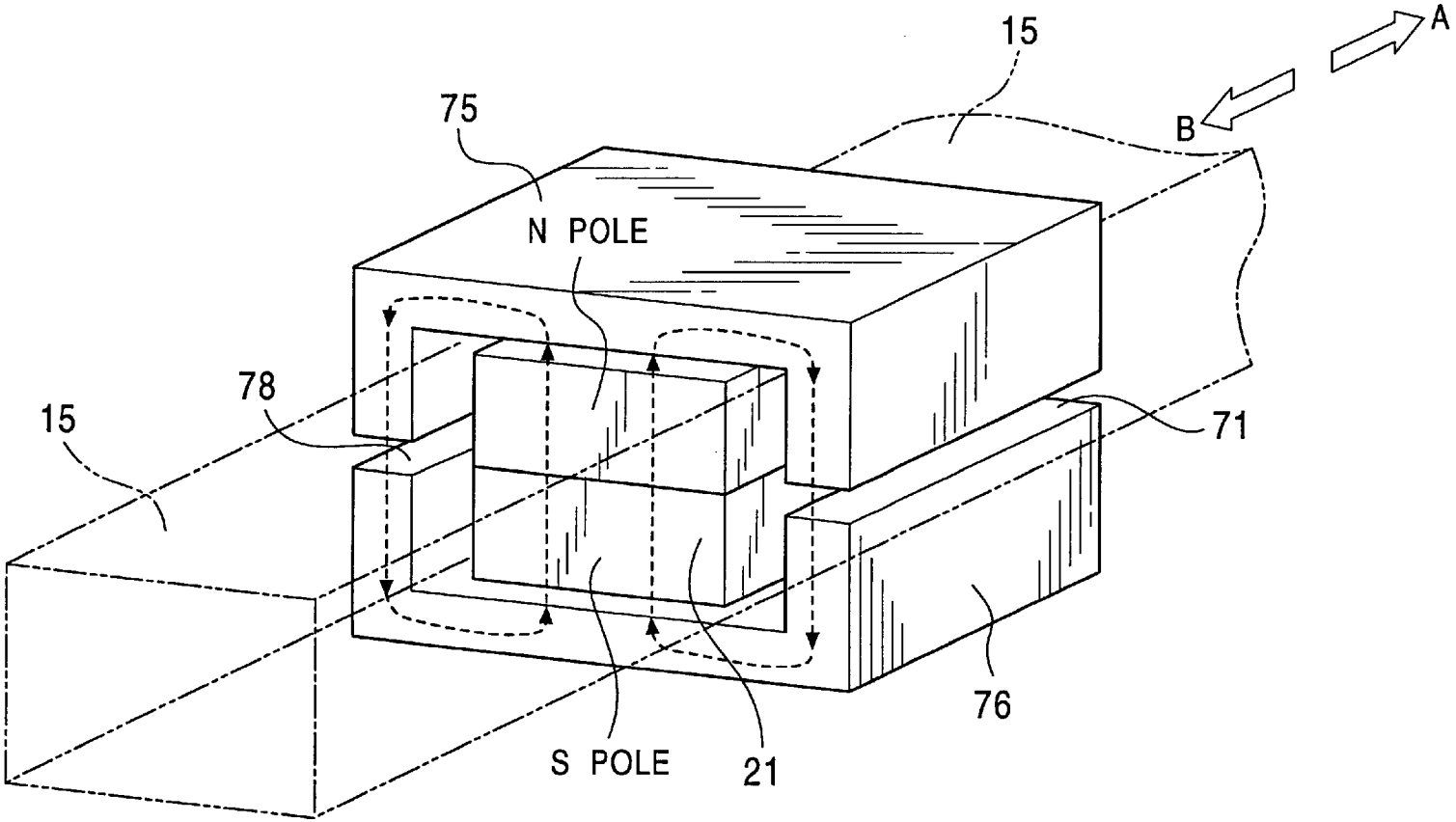
FIG. 10 is an enlarged perspective view of the yoke and the magnetized member of the valve driving apparatus shown in FIG. 9.

Yoke 71 of actuator 70 is configured to be U shaped and at the inner wall of the leg of the yoke 71, two poles 72 and 73 are set facing each other. Valve rod 15, having a rectangular cross section, is arranged at gap 74 of poles 72 and 73 so that it may slide along the lengthwise direction. In like manner as the valve rod 12 shown in FIG. 2, in the through hole (not shown) arranged in valve rod 15, a magnetic pole is provided such that the N pole of magnetized member 21 faces pole 72 and the S pole of magnetized member 21 faces pole 73. In the gap 74, a magnetic field region is formed in the neighborhood of poles 72 and 73 and magnetized member 21 is arranged to correspond with the magnetic field region. Surrounding the trunk of yoke 71, there is arranged a fixed frame 23 comprising nonmagnetic material such as resin. Along the side wall portion of fixed frame 23, there is wound electromagnetic coil 38 to surround the trunk of yoke 71. Electromagnetic coil 38 is connected to current source which is not shown and the current source supplies driving current to the electromagnetic coil 38, wherein the polarity of the current corresponds to either the valve closing direction or the valve opening direction of valve 11. Furthermore, yokes 75 and 76, which are additional magnetic path members, are arranged to sandwich valve rod 15. The N pole of magnetized member 21 faces yoke 75 and the S pole of magnetized member 21 faces yoke 76. As shown in FIG. 10, the cross sections of both yokes 75 and 76 are configured to be U-shaped and leg portions of yoke 75 and 76 are arranged so that they are opposed to each other. Also, between the legs of yoke 75 and 76, magnetic gaps 77 and 78 are arranged.

When current is not supplied to electromagnetic coil 38, magnetized member 21 is positioned at a predetermined position together with valve rod 15 so that a magnetic path is circumferentially formed in the following sequence: the N pole of magnetized member 21, magnetic pole member 72, yoke 71, magnetic pole member 73 and the S pole of magnetized member 21.

When current is supplied to electromagnetic coil 38, magnetic flux is generated in yoke 71 and a magnetic dipole is generated on the surface of both magnetic pole members 72 and 73. For example, when direct current in a predetermined direction is supplied to electromagnetic coil 38, a pole of N polarity is created at magnetic pole member 72 and a pole of S polarity is created at magnetic pole member 73. When direct current in a direction opposed to the predetermined direction is supplied to electromagnetic coil 38, the S polarity pole is created at magnetic pole member 72 and the N polarity pole is created at magnetic pole member 73.

In the case where the N pole is created at magnetic pole member 72 and the S pole is created at magnetic pole member 73, as shown by two dotted line arrows in FIG. 10, new magnetic paths are circumferentially formed in the following sequence: the N pole of magnetized member 21, yoke 75, magnetic gap 77, yoke 76, the S pole of magnetized member 21. A second sequence is: the N pole of magnetized member 21, yoke 75, magnetic gap 78, yoke 76 and the S pole of magnetized member 21 so that magnetized member 21 moves in the direction of arrow A, shown in FIGS. 9 and 10, together with the valve rod 15 according to the magnitude of the magnetic flux density generated in yoke 71. To the contrary, when the S pole is created at magnetic pole member 72 and the N pole is created at magnetic pole member 73, the two magnetic paths are extinguished so that magnetized member 21 moves to the direction of arrow B together with the valve rod 15 according to the magnitude of the magnetic flux density generated in yoke 71.

Figure 11:
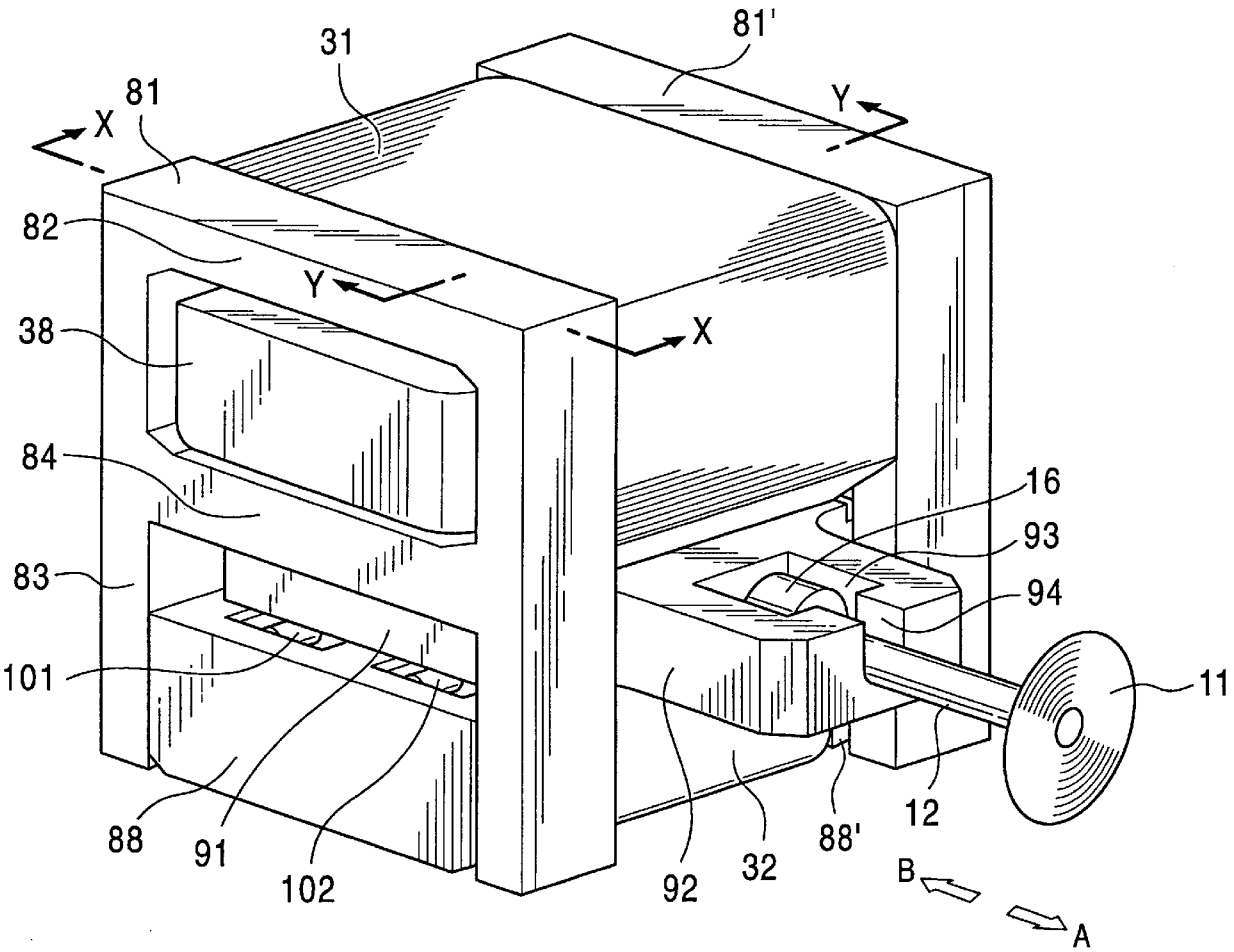
FIG. 11 is a perspective view showing a sixth embodiment of the valve driving apparatus.
Figure 12:
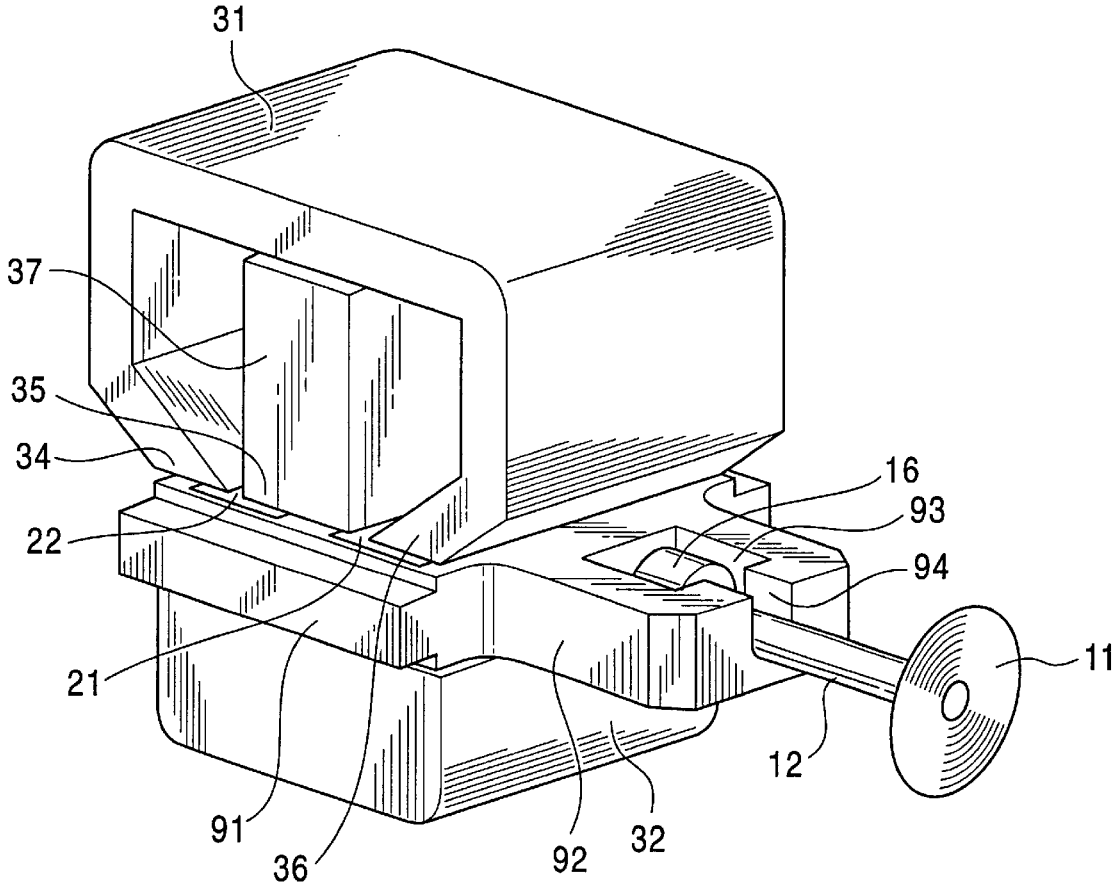
FIG. 12 is a perspective view showing the valve driving apparatus of FIG. 11 wherein the upper frame, lower frame and coil are omitted.

FIGS. 11 and 12 show a valve driving apparatus of the sixth embodiment of the present invention. Components which correspond to components shown in FIGS. 1, 6, 7, 8 and 9 are given the same reference numbers. Also, FIG. 12 shows the valve driving apparatus shown in FIG. 11 in which upper frames 81 and 81', lower frame 88 and coil 38 are omitted. Upper frame 81, which is a second supporting member, is configured in a U-shape form with top portion 82 and two legs 83. In the middle of the legs 83 is a bracket member 84 connecting the two legs. Upper frame 81' also has a structure similar to upper frame 81.

The upper frames 81 and 81' have supporting protrusions (not shown) which support yoke 31. The yoke 31 is provided with supporting holes (not shown) which correspond to the supporting protrusions. By coupling the supporting protrusions and supporting holes the frame is assembled and yoke 31 can be held in a predetermined position between the upper frames 81 and 81'. Also, when upper frames 81 and 81' are assembled to the yoke 31, the winding 38 which is wound around core 37 inside the yoke 31 is placed inside the opening formed by the top portions of upper frames 81 and 81', leg portions 83 and bracket member 84.

Figure 16:
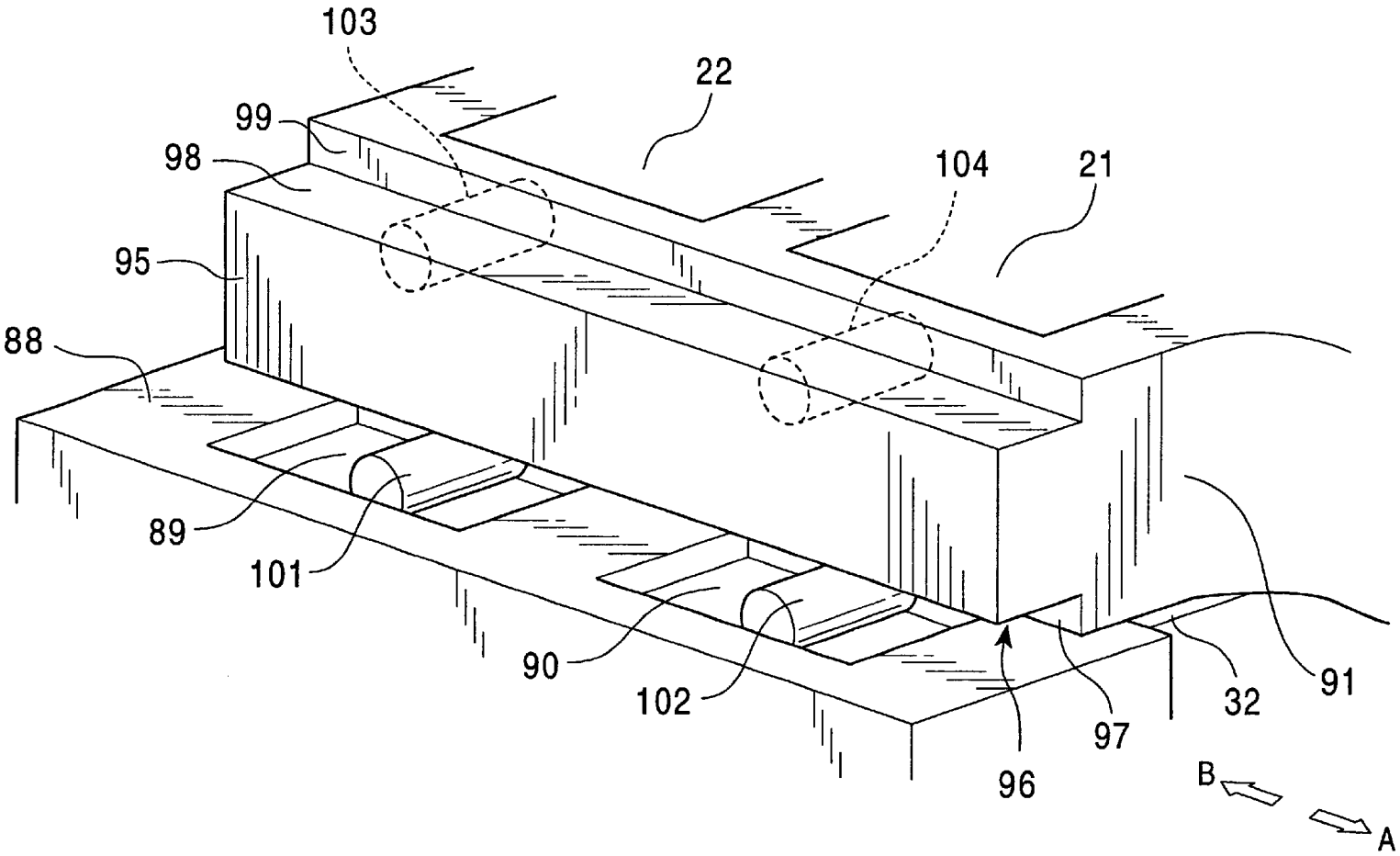
FIG. 16 is an enlarged perspective view showing the state in which a roller engages the edge of a protruded portion of the moving element and the lower frame guide groove.

As will be discussed later, moving element 91, which is a supporting body of a magnetized member, is arranged between poles 34 and 36 of yoke 31 and pole 35 of core 37 to provide a gap as shown in FIG. 12. Furthermore, the moving element 91 is arranged to also form a gap between the yoke 32, which is an independent magnetic path member. These gaps are retained by rollers 101 and 102, and 103 and 104 (FIG. 16). At an end of moving element 91, lock member 92 is provided. As mentioned later, lock member 92 has a locking hole 93 and a valve rod supporting groove 94. At an end of valve rod 12, there is an enlarged diameter portion 16 which is fit into the locking hole 93. Valve rod 12 has a valve element 11. By supplying current to coil 38 to operate the moving element, valve element 11 may be moved in the direction of arrow A (valve opening direction, for example) or in the direction of arrow B (valve closing direction, for example), as shown in the figure.

Figure 14:
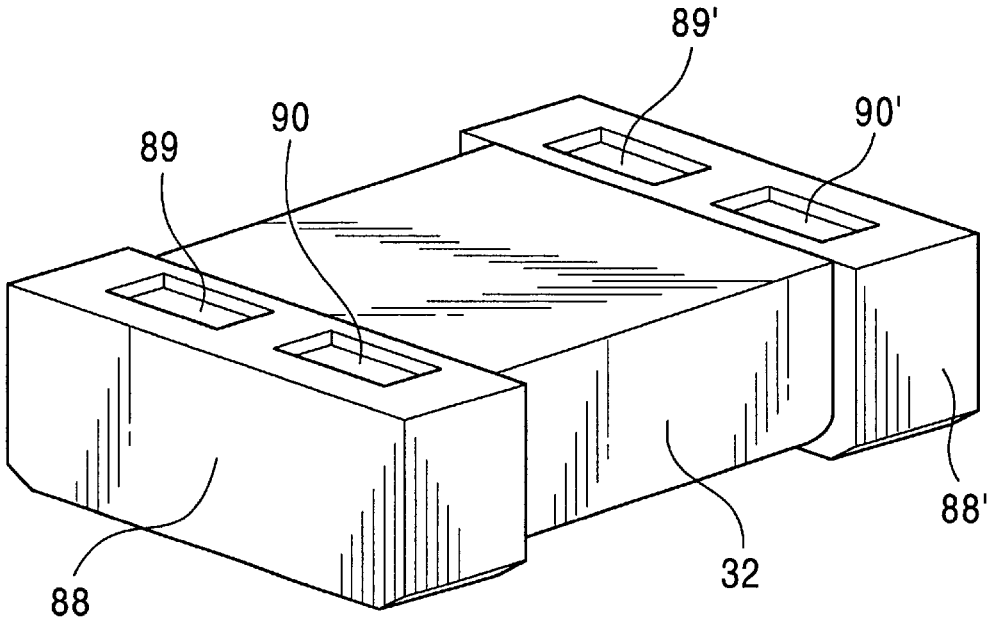
FIG. 14 is a perspective view showing the yoke held between lower frame portions.

As shown in FIG. 14, to be discussed later, lower frames 88 and 88', which are a first holding member, have supporting protrusions to support yoke 32, and yoke 32 is arranged with supporting holes (not shown in the figure) in positions corresponding to the supporting protrusions. By coupling supporting protrusions and supporting holes thereby assembling the frame, yoke 32 can be held in a predetermined position between the lower frames 88 and 88'. Lower frames 88 and 88' are arranged such that the length in the lengthwise direction is about the same as the distance between the legs 83 or 83' of the upper frames 81 or 81'. In the above structure, as shown in FIG. 11, by arranging the lower frame 88 between the two legs 83 of upper frame 81 and the lower frame 88' between the two legs 83' of upper frame 81', yoke 32 may be positioned such that it does not move in either the valve opening direction or the valve closing direction.

The upper frames 81 and 81', which are a second holding member, may have support holes (not shown) to fasten the valve driving apparatus to a predetermined location of an internal combustion engine.

Figure 13:
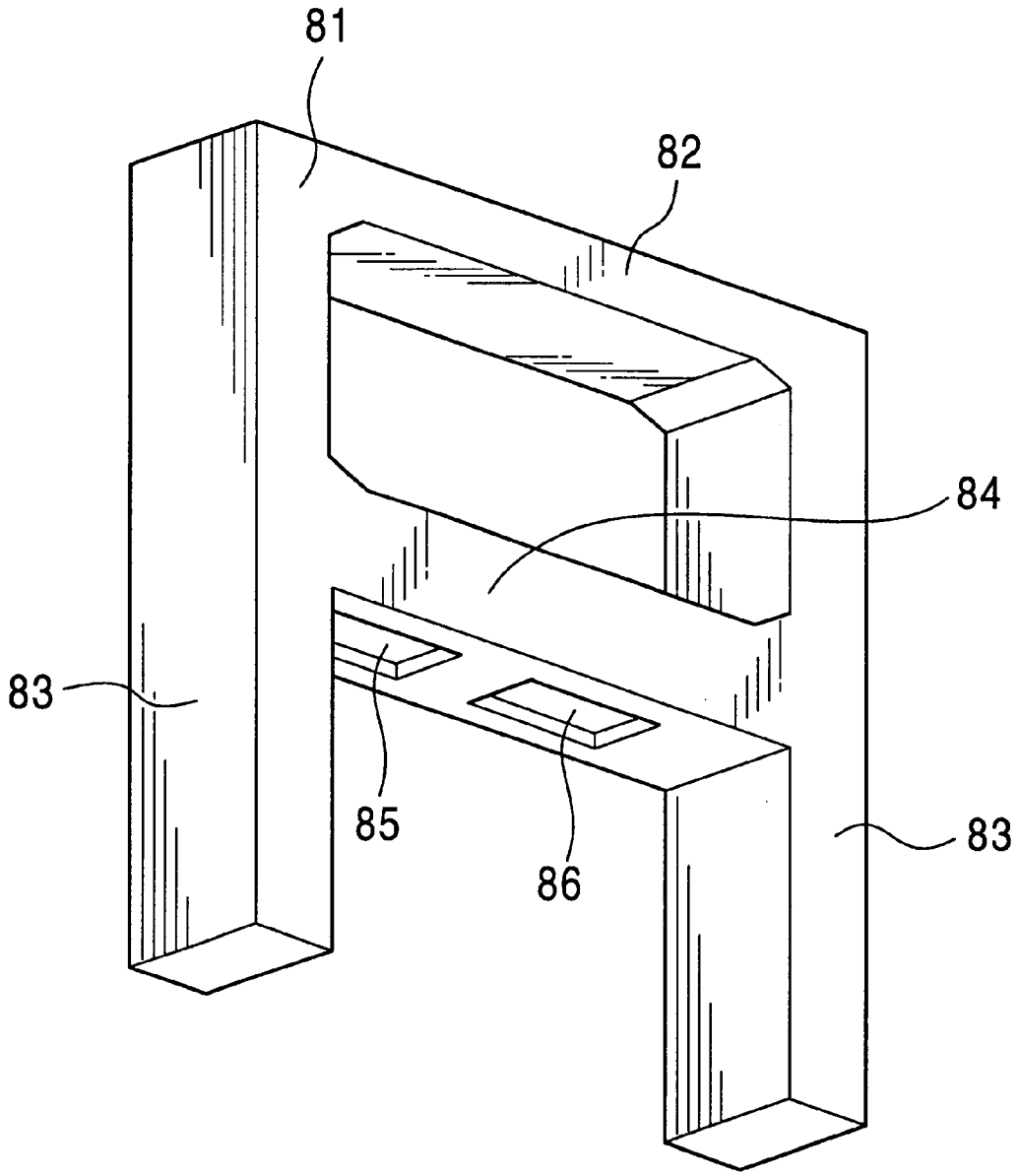
FIG. 13 is a perspective view showing the upper frame viewed from below.

FIG. 13 shows the upper frame viewed from below. Components which correspond to components shown in FIGS. 11 and 12 are given the same reference numbers.

As discussed above, the upper frame 81 has a bracket member 84 which connects the two leg 83. At the underneath surface of this bracket member 84, guide grooves 85 and 86 are formed so that the movement of second locking members, that is, rollers 103 and 104 (not shown in the figure) are guided, respectively, as will be discussed later. This guide groove, as a second guide groove, has a rectangular aperture, and its sectional configuration is also rectangular. Since this guide groove is formed underneath the bracket member 84, when the frame is assembled to form a valve driving apparatus as shown in FIG. 11, the guiding groove faces the moving element 91. Furthermore, rollers 103 and 104 roll freely in the guide grooves 85 and 86 in their lengthwise direction to form a width dimension of the guide grooves substantially identical to the overall length of the roller. The guide groove is formed so that the dimension of the depth of the guide groove is less than the diameter of the roller. Furthermore, the guide groove is formed such that the overall length of the guide groove corresponds to the moving distance of the moving element. The upper frame 81' is structured in a same manner as the upper frame 81.

FIG. 14 shows yoke 32 supported between lower frames 88 and 88'. Components which correspond to components shown in FIGS. 11 and 12 are numbered in the same manner.

The lower frame 88, which is the first supporting member, is supported between two legs 83 of the upper frame 81 such that the dimension of the lower frame 88 in the lengthwise direction is substantially equal to the distance between the two legs 83. On the top surface of the lower frame 88, first guide grooves 89 and 90 are formed. The configuration of these guide grooves 89 and 90 is substantially the same as that of guide grooves 85 and 86. Rollers 101 and 102, as a first engaging member (not shown) may roll freely in the lengthwise direction of the guide grooves 89 and 90. The lower frame 88' is structured in the same manner as the lower frame 88 and guide grooves 89' and 90' are formed in its upper surface.

Figure 15:
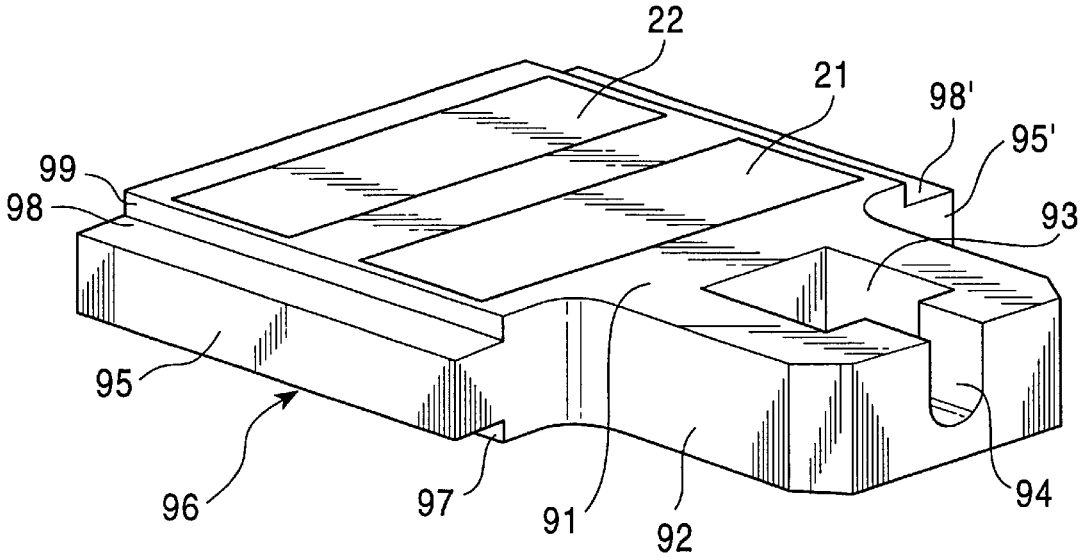
FIG. 15 is a perspective view showing the magnetized member and the moving element.

FIG. 15 shows the magnetized members and the moving element. Components which correspond to components shown in FIGS. 11 and 12 are given the same reference numbers.

The moving element 91 supports the magnetic members, and two magnetized members 21 and 22, e.g., permanent magnets, are inserted and fixed in the moving element so that the top and bottom surfaces of the magnetized members align with the top and bottom surfaces of the moving element 91. On the sides of moving element 91, protrusions 95 and 95' are arranged to protrude in a direction lateral to the length of the moving element 91. At the underneath surface of protrusions 95, lower engaging surfaces 96 are provided which respectively engage with rollers 101 and 102 (not shown), whereas at the upper surfaces of protrusion 95, upper engaging surfaces 98 are provided which respectively engage with rollers 103 and 104 (not shown). Further, underneath the protrusion 95 and at the lateral side of moving element 91, there is arranged an engaging surface 97 to engage with the circular end of rollers 101 and 102, and above the protrusion 95 and at the side of moving element 91, there is arranged an engaging surface 99 to engage with the circular end of rollers 103 and 104. With regard to protrusion 95', lower engaging surfaces 96' (not shown), upper engaging surfaces 98', engaging surface 97', and engaging surface 99' (not shown) are also arranged in the same manner as with protrusion 95.

Figure 17:
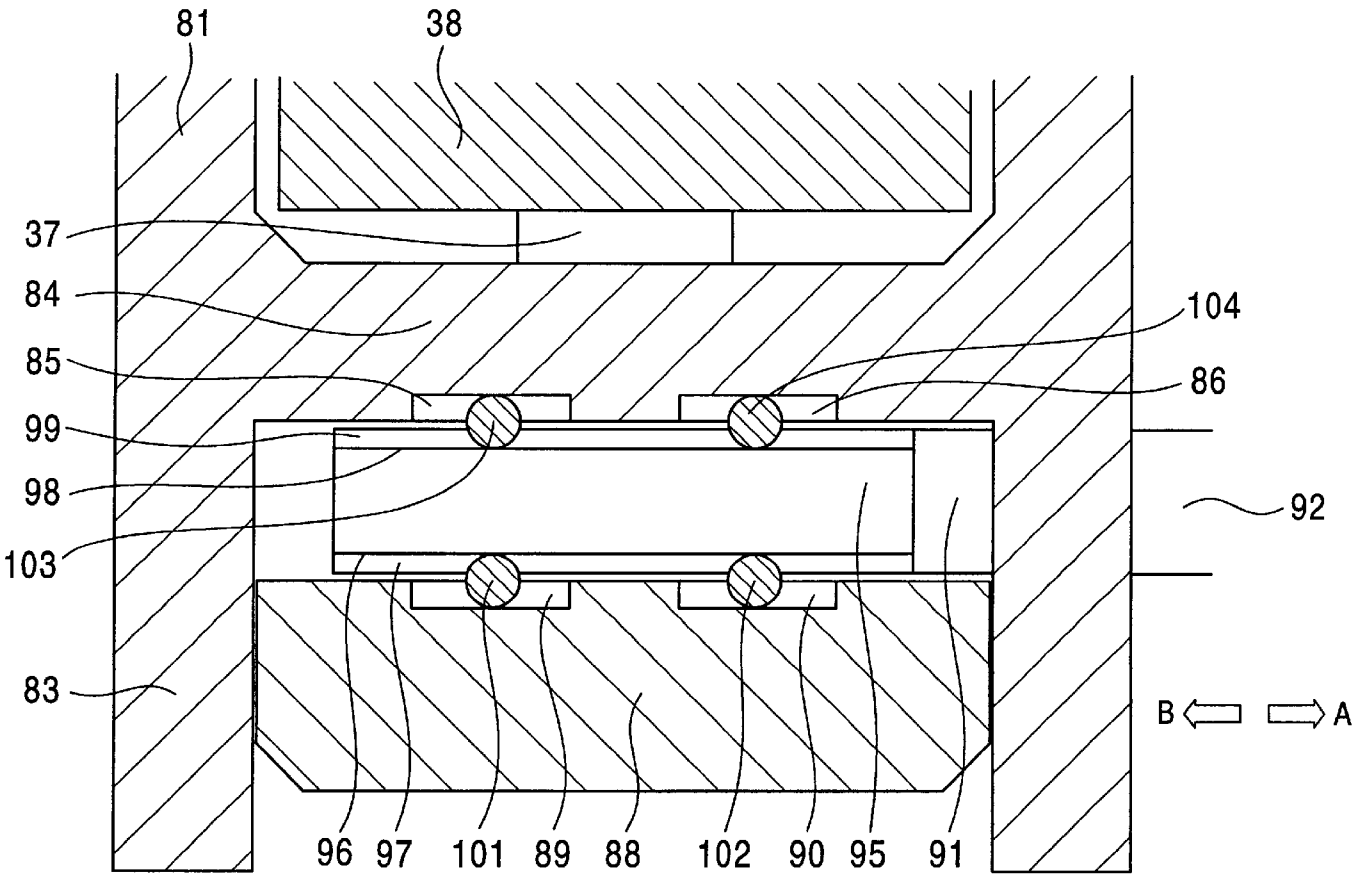
FIG. 17 is a sectional view along line X—X, shown in FIG. 11.
Figure 18:
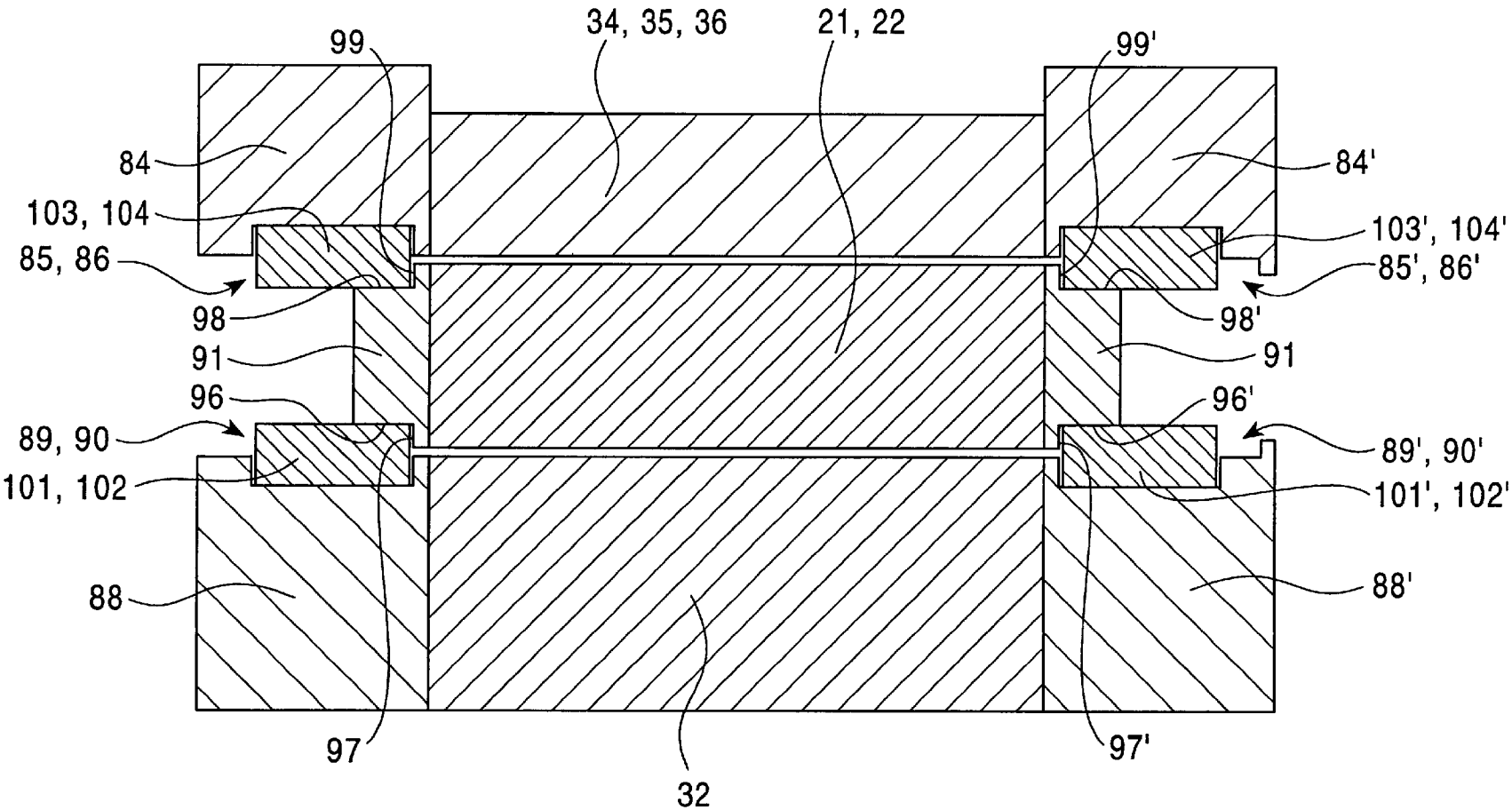
FIG. 18 is a sectional view along line Y—Y, shown in FIG. 11.

FIG. 16 is a perspective view which shows the state of the rollers engaging with the guide grooves and the protrusion of the lower frame. FIG. 17 is a sectional view along line X—X, shown in FIG. 11. FIG. 18 is a sectional view along line Y—Y, shown in FIG. 11. Components which correspond to components shown in FIGS. 11, 14 and 15 are given the same reference numbers.

Each of the rollers 101 and 102, which are the first engaging members, and each of the rollers 103 and 104, which are the second engaging members, are cylindrically configured and have a barrel shape surface and two circular end surfaces. In the following description, a circular end surface faces engaging side face 97 or 99 of the moving element 91 at the inner end surface, and a circular end surface faces in a direction opposed to the engaging side face 97 or 99 at the outer end surface.

Referring to FIGS. 16 and 17, the roller 101 is arranged in guide groove 89 of the lower frame 88, roller 102 is arranged in guide groove 90 of the lower frame 88, roller 103 is arranged in guide groove 85 of upper frame 81 and roller 104 is arranged in guide groove 86 of upper frame 81. As discussed above, the guide groove is formed so that the width of the groove is substantially equal to the length of the rollers, and by employing such a configuration, when the rollers rotate in the guide groove, the inner end surface and the outer end surface engages with the guide groove sidewall surfaces, respectively, as shown in FIG. 18, allowing the roller to move only in the lengthwise direction of the guide groove. As shown in FIGS. 16, 17 and 18, moving element 91 is arranged such that lower engaging surface 96 of the moving element 91 is capable of engaging with the barrel surface of rollers 101 and 102. Engaging side face 97 of the moving element 91 is capable of engaging with the inner end surfaces of rollers 101 and 102. Furthermore, moving element 91 is arranged such that upper engaging surface 98 of the moving element 91 is capable of engaging with the barrel surface of rollers 103 and 104. Engaging side face 99 of the moving element 91 is capable of engaging with the inner end surfaces of rollers 103 and 104.

As shown in FIG. 18, guide groves 85', 86',89' and 90' are also configured in the same manner. Rollers 101',102',103' and 104' are also configured in the same manner as rollers 101 to 104. Finally, engaging side faces 97' or 99', lower engaging surface 96' and upper engaging surface 98' are configured in the same manner as the above-mentioned counterparts.

By employing the above-mentioned configuration, when current is applied to the electromagnetic coil shown in FIG. 11 it forms a circumferential magnetic path in the following sequence: core 37, yoke 31, magnetized members 21 and 22, and yoke 32 to move the moving element 91. Then as shown in FIG. 18, engaging side face 97 of the moving element 91 engages with the inner end surfaces of rollers 101 and 102, engaging side face 99 of the moving element 91 engages with the inner end surfaces of rollers 103 and 104, engaging side face 97' of the moving element 91 engages with the inner end surfaces of rollers 101' and 102' and engaging side face 99' of the moving element 91 engages with the inner end surfaces of rollers 103' and 104' to slide the moving element 91.

The rollers 101 to 104 and 101' to 104' allow smooth movement of the moving element 91 in the desired direction. As shown in FIG. 17, these rollers also function to determine the distance between the moving element 91 and upper frames 81 and 81' as well as between the moving element 91 and lower frames 88 and 88'. Furthermore, as discussed above, upper frames 81 and 81' support the yoke 21 and the core 37 and lower frames 88 and 88' support the yoke 32 so that rollers 101 to 104 and 101' to 104' determine the gap between magnetized members 21 and 22 and magnetic poles 34, 35 and 36 as well as the gap between magnetized members 21 and 22 and the yoke 32.

Magnetic force generated from the magnetic flux of magnetized members 21 and 22 draws the magnetized members 21 and 22 in the direction of yoke 21 and core 37 and also draws yoke 32 in the direction of the magnetized members 21 and 22. Due to this magnetic force, as shown in FIG. 11 where the lower frame 88 is arranged between two legs 83 of the upper frame 81 and lower frame 88' is arranged between two legs 83' of the upper frame 81', no supporting member is required to hold the yoke 32 towards the yoke 31(in the upper direction in FIG. 11), and yoke 32 and lower frame 88 and 88' may be supported towards the yoke 31.

Figure 19:
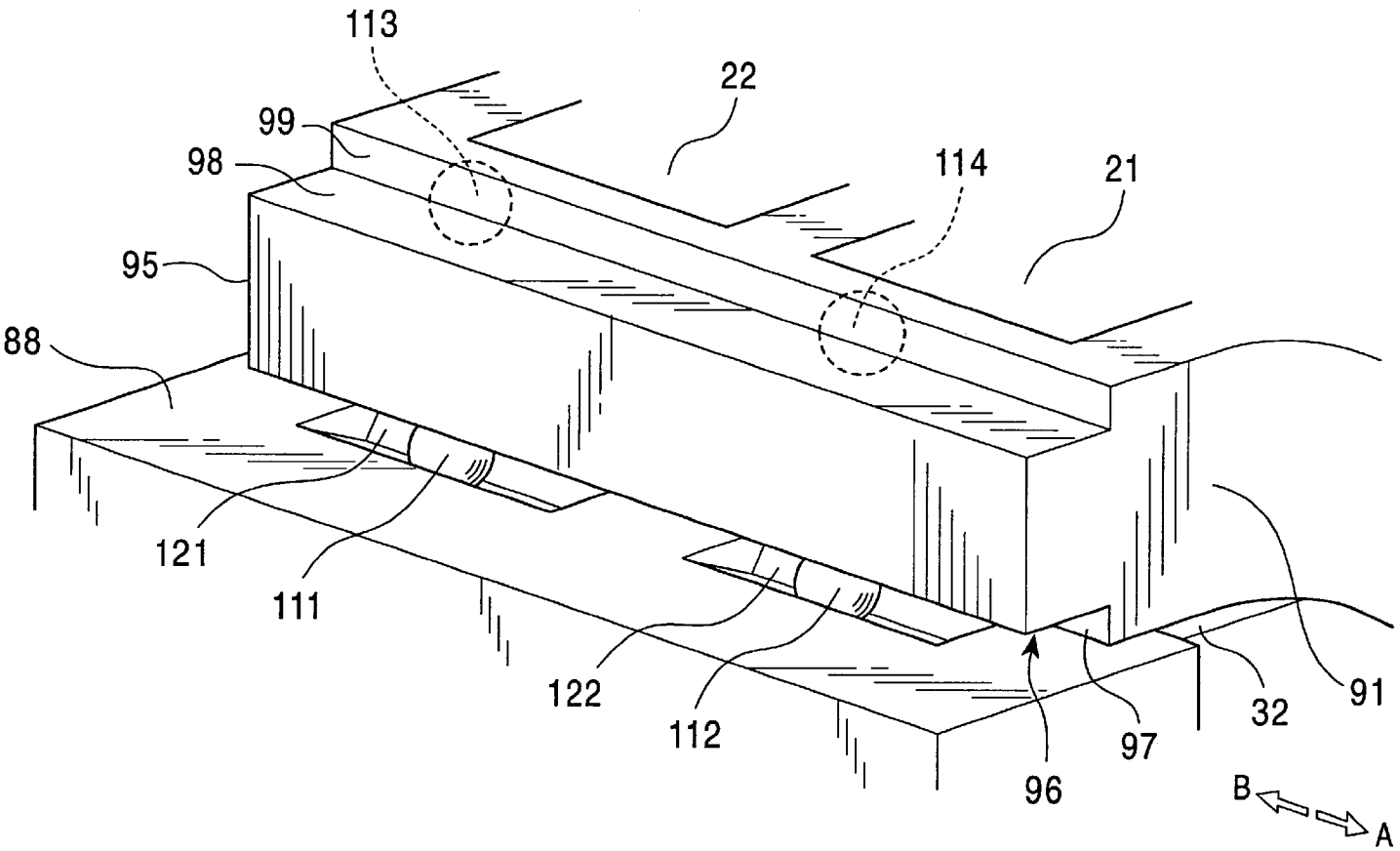
FIG. 19 is an enlarged perspective view showing the state in which a spheroid engages the edge of the protruded portion of the moving element and the lower frame guide groove.

In the foregoing embodiment, cylindrical rollers 101 to 104 and 101' to 104' were characterized as the first engaging member and the second engaging member. However, as shown in FIG. 19, spheroid elements 111 to 114 may be provided. In this case, by configuring the cross sections of first guide groove 121 and 122 and the second guide groove (not shown) to a V shape, spheroid elements 111 to 114 may be securely engaged to the first guide groove and the second guide groove.

Figure 20:
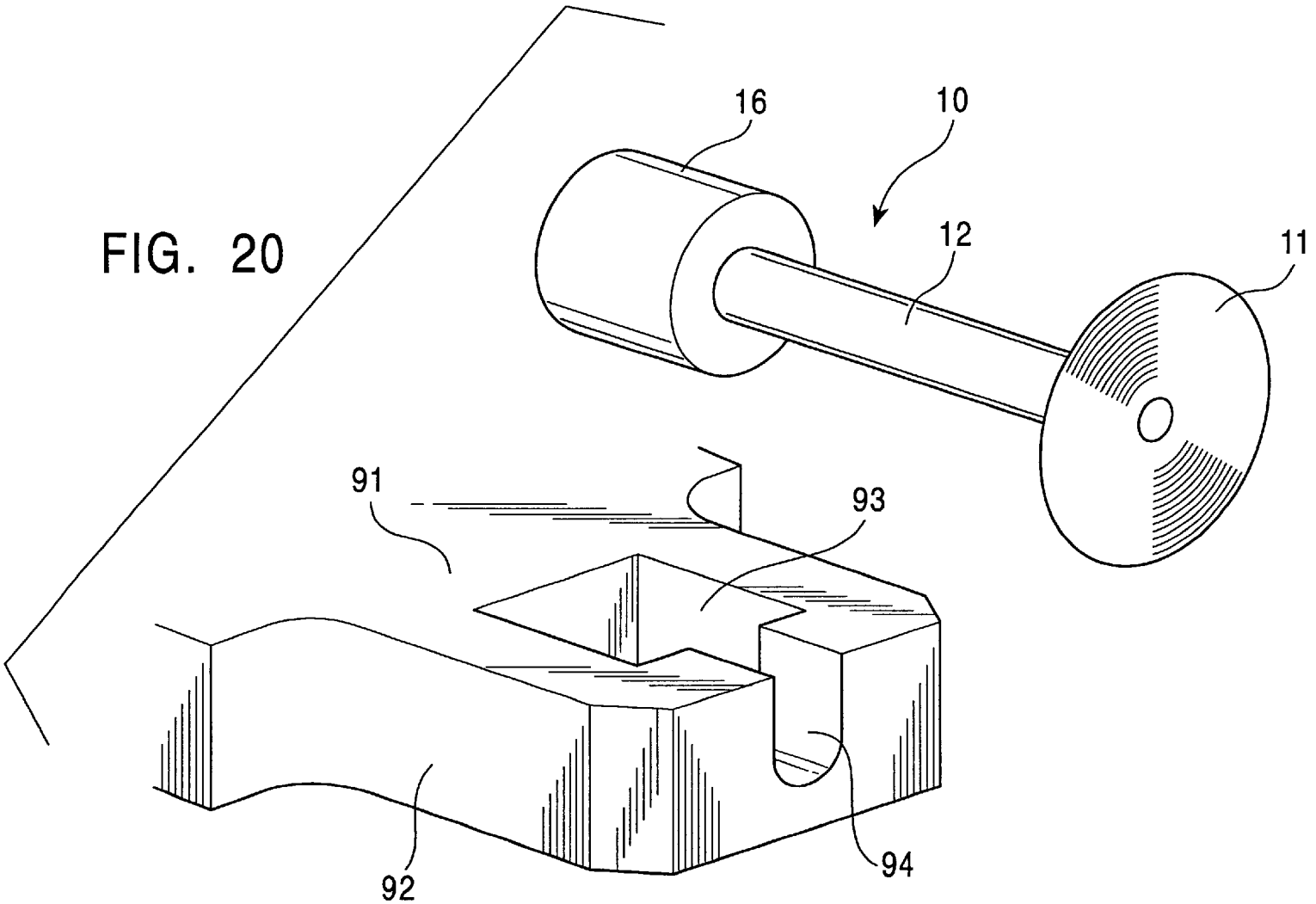
FIG. 20 is an enlarged perspective view showing a fitting portion of the moving element and the valve element.

FIG. 20 shows a lock member of the moving element and a valve element.

Valve head 11 of the valve element 10 is circular when viewed from the front and the valve head 11 is connected to the end of the valve rod 12 to form a uniform member. At the other end of the valve rod 12, there is an enlarged diameter element 16 having a diameter greater than the valve rod 12.

Referring to lock member 92 fixed at the moving element 91, a locking hole 93 is formed with a rectangular aperture and a rectangular sectional configuration. In a front portion of the lock member 92, there is a supporting groove 94 having a U-shaped cross section, viewed from the surface of the lock member 92 towards the locking hole 93.

When inserting the enlarged diameter portion 16 into the locking hole 93 to assemble the valve element 10 to the moving element 91, the side face of locking hole 93 engages with the barrel surface and circular end surface of the enlarged diameter portion 16 and the support groove engages with the barrel surface of the valve rod 12 to support the valve element 10 to the lock member 92. By employing such a structure, valve element 10 may be easily and accurately installed to the moving element 91. Furthermore, when locking hole 93 is designed according to the configuration of the conventional valve element, the conventional valve element may be assembled to the valve driving apparatus disclosed in the sixth embodiment without adding any modification to the valve element.

In the foregoing embodiment, the end portion of valve rod 12 is shown as having an enlarged diameter portion 16 of cylinder shape, but the end portion may be formed differently, such as a spherical body. Also, the aperture configuration of the locking hole 93 may be another polygonal shape other than rectangular.

As described above, the valve driving apparatus according to the present invention allows to simplification of the configuration of the apparatus, reducing valve seating impact and precisely controlling the valve element.

What is claimed is:

1. A valve driving apparatus for driving a valve element controlling intake gas flow or exhaust gas flow of an internal combustion engine, comprising:

a valve driving portion including a magnetic path which comprises:

a magnetic flux generating element comprising an electromagnetic coil wound so as to generate a magnetic flux; and a magnetic field generating element comprising three pole members to distribute the magnetic flux and form at least one magnetic field;

a magnetized member that is movable within said magnetic field in cooperation with a valve rod that is integral with a valve element, said magnetized member having two magnetized surfaces with different polarities; and a current supply for supplying a driving current to said electromagnetic coil so as to correspond to a valve opening direction and a valve closing direction;

wherein said three pole members are aligned in a lengthwise direction of said valve rod;

wherein said electromagnetic coil is wound about an axis perpendicular to the lengthwise direction; and wherein a gap between one of said three pole members and said magnetized member is different in size from a gap between at least one other of said three pole members and said magnetized member.

2. The valve driving apparatus of claim 1, wherein said magnetic field generating element comprises a yoke and a core inside said yoke, said core and said yoke being separate from each other.

3. The valve driving apparatus of claim 1, wherein said magnetic path comprises a gap therein formed at a location that substantially corresponds to the position of said gap between said one of said three pole members and said magnetized member.

4. The valve driving apparatus of claim 1, wherein said gap between said one of said three pole members and said magnetized member is larger than said gap between the at least one other of said three pole members and said magnetized member so as to define a reference position of said valve rod by cooperation of the at least one other of said three pole members with said magnetized surfaces of said magnetized member when no driving current is supplied by said current supply to said electromagnetic coil.

5. The valve driving apparatus of claim 1, wherein said magnetic field generating element comprises a first yoke and said valve driving apparatus further comprises a second yoke, said magnetized member being positioned in a gap between said first yoke and said second yoke.

6. The valve driving apparatus of claim 4, wherein said magnetized member comprises a plurality of permanent magnets spaced from each other in the lengthwise direction of said valve rod and said two magnetized surfaces with different polarities are spaced from each other in the lengthwise direction.

7. A valve driving apparatus for driving a valve element controlling intake gas flow or exhaust gas flow of an internal combustion engine, comprising:

a valve driving portion including a magnetic path which comprises:

a magnetic flux generating element comprising an electromagnetic coil wound so as to generate a magnetic flux; and a magnetic field generating element comprising three pole members to distribute the magnetic flux and form at least one magnetic field;

a magnetized member that is movable within said magnetic field in cooperation with a valve rod that is integral with a valve element, said magnetized member having two magnetized surfaces with different polarities;

a current supply for supplying a driving current to said electromagnetic coil so as to correspond to a valve opening direction and a valve closing direction;

wherein said three pole members are aligned in a lengthwise direction of said valve rod;

wherein said electromagnetic coil is wound about an axis perpendicular to the lengthwise direction;

wherein said magnetic field generating element comprises a yoke and a core inside said yoke, and said magnetic path comprises a gap in said yoke that magnetically separates a first part of said yoke including one of said three pole members from a second part of said yoke and from said core, said second part of said yoke and said core including the other two of said three pole members; and wherein a gap between said one of said three pole members and said valve rod that is larger than a gap between the other two of said three pole members and said valve rod.

* * * * *